US009076619B2

(12) United States Patent
Page et al.

(10) Patent No.: US 9,076,619 B2
(45) Date of Patent: Jul. 7, 2015

(54) MINIATURE MAGNETIC SWITCH STRUCTURES

(71) Applicants: William C. Page, Norcross, GA (US); Lawrence DiFrancesco, Colorado Springs, CO (US); Dain P. Bolling, Sebastian, FL (US); David P. Paturel, San Marino, CA (US)

(72) Inventors: William C. Page, Norcross, GA (US); Lawrence DiFrancesco, Colorado Springs, CO (US); Dain P. Bolling, Sebastian, FL (US); David P. Paturel, San Marino, CA (US)

(73) Assignee: Telepath Networks, Inc., Raleigh, NC (US)

( * ) Notice: Subject to any disclaimer, the term of this patent is extended or adjusted under 35 U.S.C. 154(b) by 0 days.

(21) Appl. No.: 13/869,788

(22) Filed: Apr. 24, 2013

(65) Prior Publication Data

US 2014/0043118 A1 Feb. 13, 2014

Related U.S. Application Data

(63) Continuation of application No. 12/838,160, filed on Jul. 16, 2010, now Pat. No. 8,432,240.

(51) Int. Cl.

| | |
|---|---|
| ***H01H 51/22*** | (2006.01) |
| ***H01H 53/015*** | (2006.01) |
| ***H01H 49/00*** | (2006.01) |
| *H01H 50/00* | (2006.01) |
| *H01H 1/00* | (2006.01) |

(52) U.S. Cl.

CPC ..... *H01H 53/015* (2013.01); *Y10T 29/49073* (2015.01); *Y10T 29/24* (2015.01); *H01H 50/005* (2013.01); *H01H 2001/0073* (2013.01); *H01H 49/00* (2013.01)

(58) Field of Classification Search

CPC ... H01H 53/015; H01H 49/00; H01H 50/005; H01H 2001/0073; Y10T 29/49073; Y10T 29/24

USPC ..... 335/78; 200/181; 29/622

See application file for complete search history.

(56) References Cited

U.S. PATENT DOCUMENTS

| | | | | |
|---|---|---|---|---|
| 5,629,918 | A * | 5/1997 | Ho et al. | 310/40 MM |
| 6,169,469 | B1 * | 1/2001 | Misumi et al. | 335/78 |
| 6,310,526 | B1 * | 10/2001 | Yip et al. | 333/262 |
| 6,542,379 | B1 * | 4/2003 | Lauffer et al. | 361/793 |
| 6,812,814 | B2 * | 11/2004 | Ma et al. | 333/262 |
| 7,142,743 | B2 * | 11/2006 | Bernstein | 385/18 |
| 2005/0047010 | A1 * | 3/2005 | Ishiwata et al. | 360/123 |
| 2005/0270127 | A1 * | 12/2005 | Six | 335/78 |
| 2011/0037542 | A1 * | 2/2011 | Page et al. | 335/78 |

* cited by examiner

*Primary Examiner* — Bernard Rojas

(74) *Attorney, Agent, or Firm* — Greenberg Traurig, LLP; Franklin D. Ubell

(57) ABSTRACT

According to an illustrative embodiment, a switching device structure is provided comprising a cavity defined by a laminated structure; and a moveable member comprising a plurality of laminated layers, wherein the moveable member is suspended from a side surface of the cavity by a hinge comprising a plurality of adjacent electrical conductors. In one embodiment, a current conducting coil is formed within the moveable member, and first and second of the adjacent electrical conductors of the hinge respectively comprise coil-in and coil-out conductors electrically connected to the coil. In such an embodiment, the third and fourth of said electrical conductors may respectively comprise tip and ring conductors. In illustrative embodiments, each of the electrical conductors of the hinge may comprise a resilient or flexible copper material.

8 Claims, 25 Drawing Sheets

MINIATURE MAGNETIC SWITCH STRUCTURES

CROSS REFERENCE TO RELATED APPLICATIONS

This application is a continuation of U.S. patent application Ser. No. 12/838,160, entitled "MINIATURE MAGNETIC SWITCH STRUCTURES" filed on Jul. 16, 2010, the contents of which are hereby incorporated herein by reference in its entirety.

FIELD

The subject disclosure pertains to the field of switching devices and relays and more particularly to miniature switching devices fabricated from a number of laminated layers.

RELATED ART

Electromechanical and solid state switches and relays have long been known in the art. More recently, the art has focused on micro electromechanical systems (MEMS) technology.

SUMMARY

The following is a summary description of illustrative embodiments of the invention. It is provided as a preface to assist those skilled in the art to more rapidly assimilate the detailed design discussion which ensues and is not intended in any way to limit the scope of the claims which are appended hereto in order to particularly point out the invention.

According to an illustrative embodiment, a switching device structure is provided comprising a cavity defined by a laminated structure; and a moveable member comprising a plurality of laminated layers, wherein the moveable member is suspended from a side surface of the cavity by a hinge comprising a plurality of adjacent electrical conductors. In one embodiment, at least one electrical current conducting coil is formed within the moveable member, and first and second of the adjacent electrical conductors of the hinge respectively comprise coil-in and coil-out conductors electrically connected to the coil. In such an embodiment, the third and fourth of the electrical conductors may respectively comprise tip and ring conductors. In illustrative embodiments, each of the electrical conductors of the hinge may comprise a resilient or flexible copper material. In various embodiments, the moveable member also has an electromagnet core disposed within one or more current conducting coils.

DETAILED DESCRIPTION OF ILLUSTRATIVE EMBODIMENTS

Figure 1:
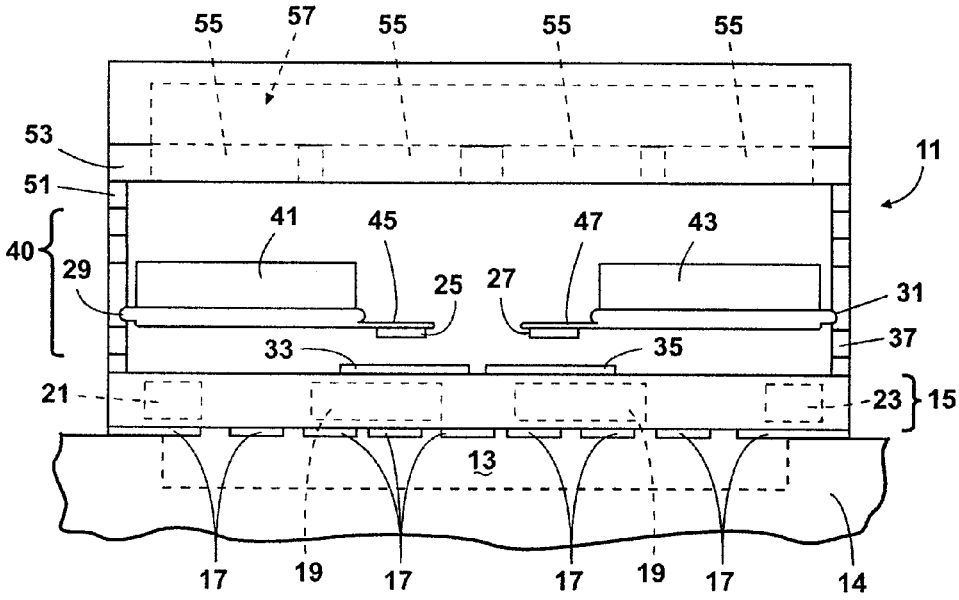
FIG. 1 is a side schematic side view of a switching device structure according to an illustrative embodiment.

A TEMS switching device structure 11 according to an illustrative embodiment is shown schematically in FIG. 1. As shown in the top view of FIG. 2, the device 11 may include two rows of four switches or relays $R_1$, $R_2$, $R_3$, $R_4$, $R_5$, $R_6$, $R_7$, $R_8$, totaling eight switches in all. Various other layouts of varying numbers of switches or relays are of course possible, depending on the application.

The device structure 11 of the illustrative embodiment shown in FIG. 1 includes a bottom magnet 13 which resides in a well in a circuit card 14 to which the TEMS device 11 is mounted. Above the bottom magnet 13 is a base subassembly 15, which consists of a number of layers laminated together. The bottom most of these layers mounts electrical contacts 17, which connect the device 11 to electrical conductors on the circuit card 14. Another of the layers of the base subassembly 15 comprises a number of drilled out cylinders and two routed-out end strips, which are filled with an iron epoxy mix to form iron posts, e.g. 19, and iron strips 21, 23. These posts 19 and strips 21, 23 serve to channel the magnetic force of the bottom magnet 13 toward respective armature flappers 45, 47 and armature rear ends 29, 31.

The top layer of the base subassembly 15 carries respective electrically conductive flapper landing pads 33, 35. Above the base subassembly 15 is a first "ring frame" layer 37, which, in an illustrative embodiment, is a polyglass spacer with a rectangular cutout exposing each of the eight (8) switches $R_1$, $R_2$, $R_3$, $R_4$, $R_5$, $R_6$, $R_7$, $R_8$.

Above the first ring frame layer 37 is an armature subassembly 40, which may, for example, in an illustrative embodiment, comprise eleven (11) layers laminated together, as discussed in more detail below. The layers of the armature subassembly 40 are processed to form electromagnets, e.g. 41, 43 having iron cores with inner and outer conductive windings. The electromagnets 41, 43 are disposed on the respective flappers 45, 47, which carry respective electrical contacts 25, 27. A second ring frame spacer 51 is added on top of the armature subassembly 40.

Figure 2:
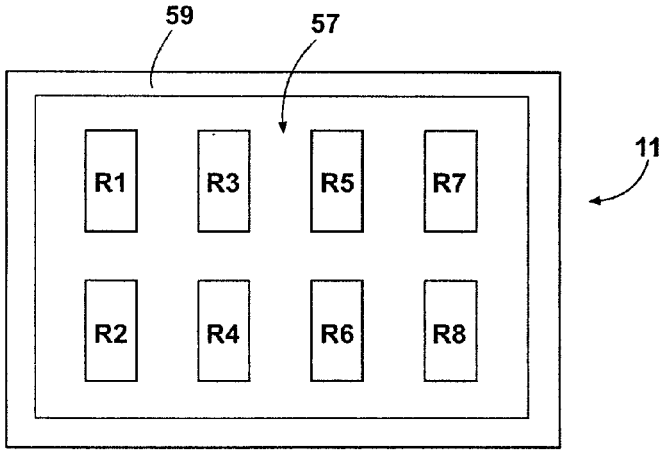
FIG. 2 is a top schematic view of one embodiment of an array of switches constructed according to FIG. 1.

An iron post layer 53 is applied on top of the second ring frame spacer 51. The post layer 53 comprises, for example, sixteen (16) iron epoxy-filled cylinders forming iron posts 55, which channel the magnetic force of a rectangular top magnet 57 to the respective armature flappers 45, 47 and front and rear end 29,31. The top magnet 57 may be mounted within a top magnet frame 59 (FIG. 2).

The top and bottom magnets 13, 57, may be, for example, Neodymium magnets formed of Neodymium alloy $Nd_2Fe_{14}B$, which is nickel plated for corrosion protection. NdFeB is a "hard" magnetic material, i.e., a permanent magnet. In one embodiment, the top magnet may be 375×420×90 mils, and the bottom magnet may be 255×415×110 mils.

In illustrative operation of the device 11, a positive pulse to the armature 41 pulls the armature flapper 45, down, creating an electrical connection or signal path between flapper contact 25 and the landing pad or contact 33. The contacts 25 and 33 are thereafter maintained in a "closed" state by the bottom magnet 13. Thereafter, a negative pulse to the armature 41 repels the flapper 45 away from the bottom magnet 13 and attracts it to the top magnet 57, which holds the flapper 45 in the open position after the negative pulse has passed. In one embodiment, the driver pulse may be, for example, 3 amps at 5 milliseconds.

Figure 3:
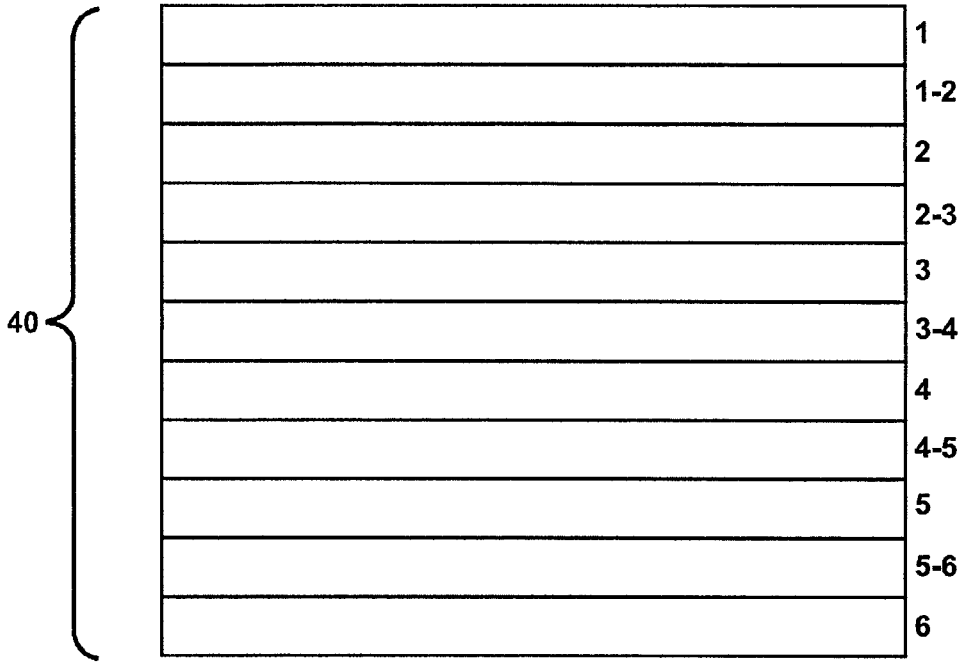
FIG. 3 is a side schematic side view illustrating the positioning of the layers of an illustrative embodiment of an armature assembly.

FIG. 3 illustrates the positioning of the eleven layers of an illustrative armature assembly 40. Each of these layers are, in general, formed of an insulator such as polyamide glass with, for example, copper, tin or other suitable electrical conductor materials. In one embodiment, polyamide glass substrates plated with copper layers may be patterned with photo resist and etched to create the desired contact and/or conductor patterns of the armature subassembly layers. Vias may be fabricated in the layers using known techniques.

Figure 4A:
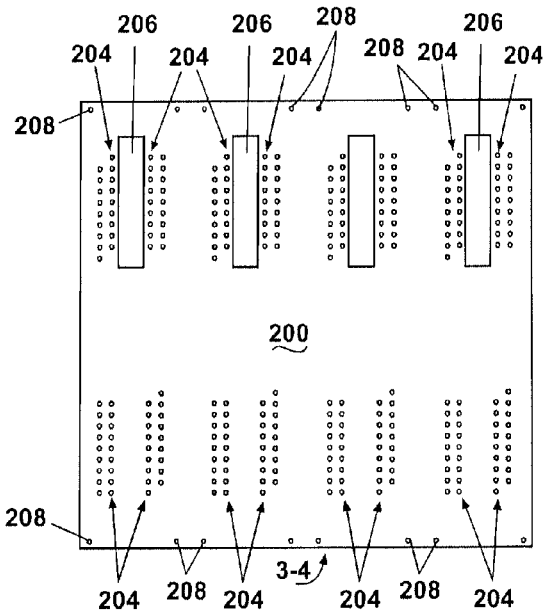
FIG. 4A is a top view of layer 3-4 of FIG. 3.
Figure 4B:
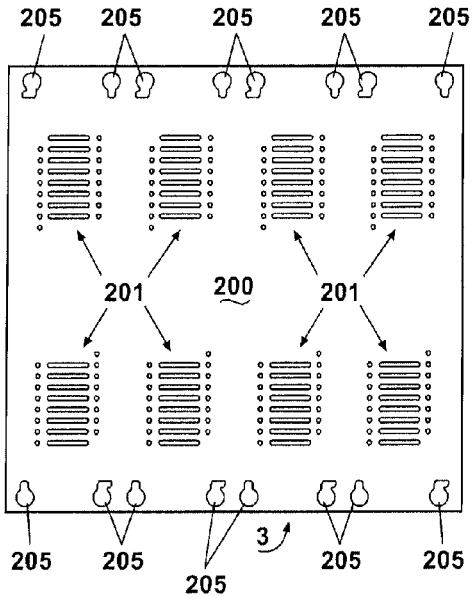
FIG. 4B is a top view of layer 3 of FIG. 3.
Figure 4C:
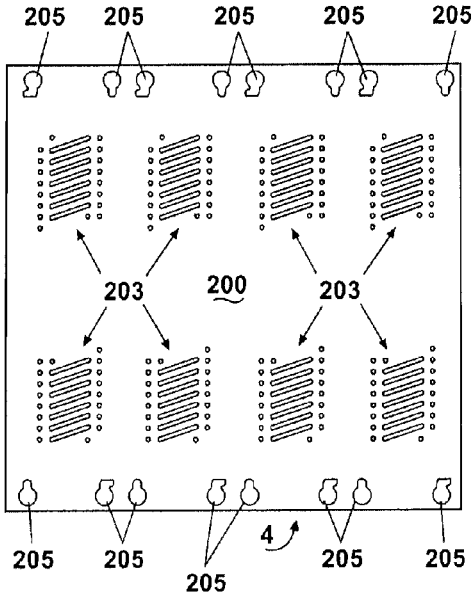
FIG. 4C is a top view of layer 4 of FIG. 3.
Figure 5A:
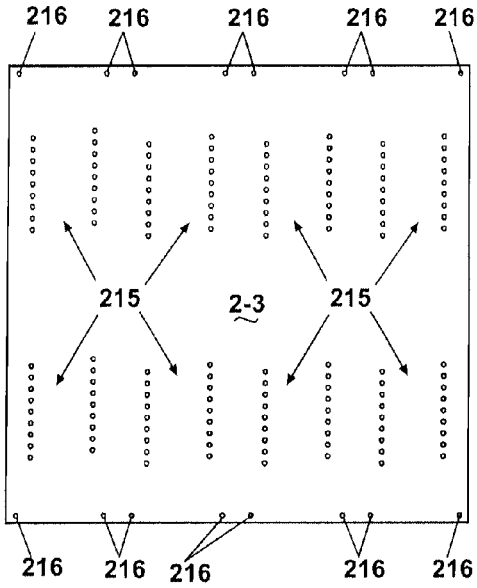
FIG. 5A is a top view of layer 2-3 of FIG. 3.
Figure 5B:
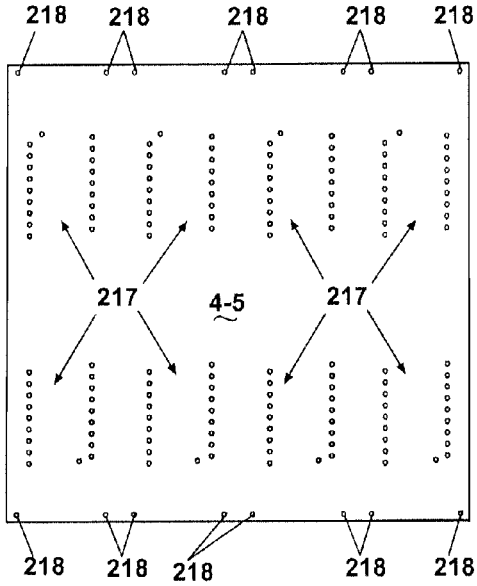
FIG. 5B is a top view of layer 4-5 of FIG. 3.
Figure 5C:
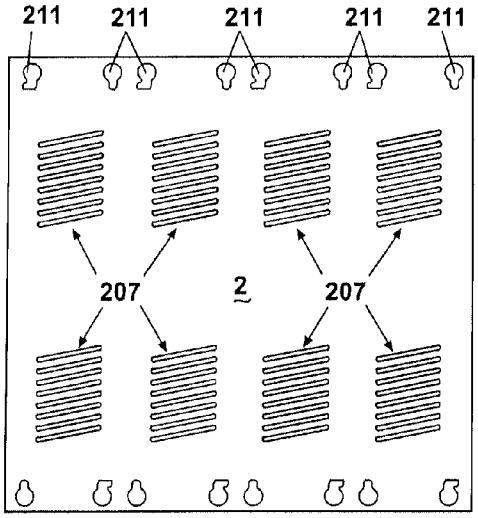
FIG. 5C is a top view of layer 2 of FIG. 3.
Figure 5D:
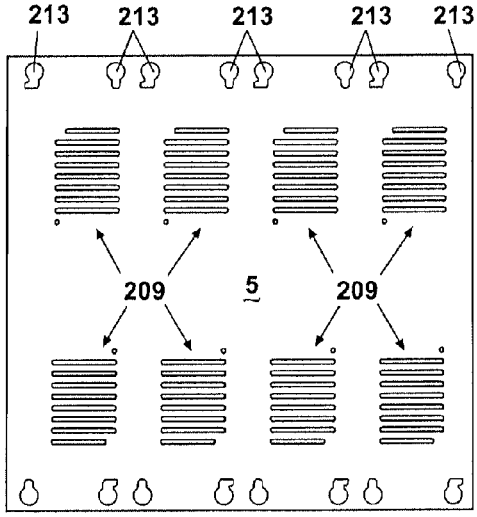
FIG. 5D is a top view of layer 5 of FIG. 3.

FIGS. 4A, 4B, and 4C respectively illustrate three of the armature subassembly layers 3, 4 and 3-4. Layers 3 and 4 each include eight armature winding conductor patterns, 201, 203 formed on respective insulating substrates 200 and eight vias 205 positioned along their respective top and bottom edges. As will be appreciated, one of the conductor patterns 201, 203 is associated with a respective one of the eight switches $R_1$, $R_2$, $R_3$, $R_4$, $R_5$, $R_6$, $R_7$, $R_8$, shown in FIG. 2.

Layer 3-4 of FIG. 4A is positioned between layers 3 and 4 and contains eight pairs of via rows, e.g. 204, each via of which is positioned to appropriately connect with the armature winding conductor patterns 201, 203. Rectangular cavities 206 are routed out of layer 3-4 between the vias 204 and filled with material to form the cores of the armatures' electromagnets e.g. 41, 43. In the illustrative embodiment, an iron powder epoxy mix is used to form iron electromagnet cores. Vias, e.g. 208, are also established along the top and bottom edges of the layer 3-4 substrate. Then, layers 3 and 4 are laminated to opposite sides of layer 3-4 to form the inner winding of the armatures' electromagnets, e.g. 41, 43.

FIGS. 5A, 5B, 5C, and 5D illustrate a respective one of four more of the armature layers: 2-3, 4-5, 2 and 5. Layers 2 and 5 each include eight armature winding conductor patterns 207, 209 and eight vias 211, 213 along their respective top and bottom edges. Layers 2-3 and 4-5 again contain eight respective via pairs 215, 217 positioned to appropriately connect and facilitate current flow through the armature winding conductor patterns 207, 209. Suitable vias, e.g. 216, 218 are established along the respective top and bottom edges of the layer 2-3 and 4-5 substrates.

To further construct the armature, the armature layer 2-3 is laminated to layer 3 of FIG. 4B, and layer 4-5 is laminated to layer 4 of FIG. 4C, thereby forming the connections for the armature outer windings. Next, layer 2 is laminated to layer 2-3 and layer 5 is laminated to layer 4-5 to complete the outer winding of the armatures' electromagnets, e.g. 41, 43.

Figure 6A:
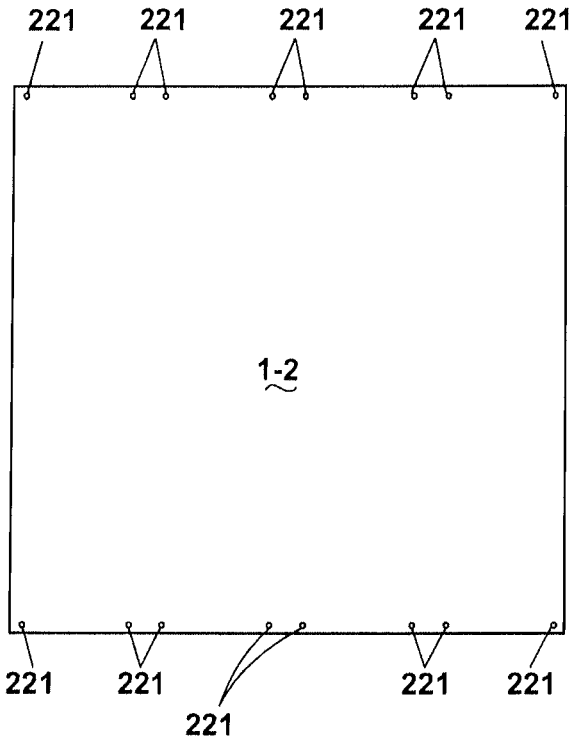
FIG. 6A is a top view of layer 1-2 of FIG. 3.
Figure 6B:
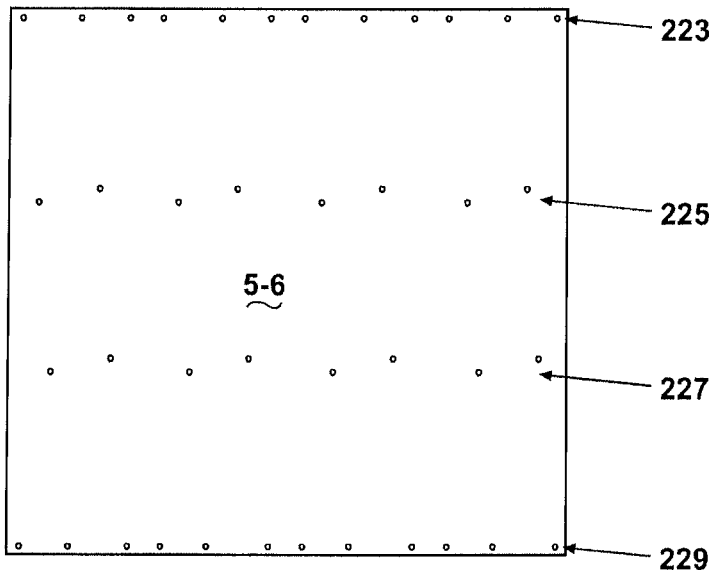
FIG. 6B is a top view of layer 5-6 of FIG. 3.

The next two layers, 1-2 and 5-6, of the armature subassembly 40 are illustrated in FIGS. 6A and 6B, respectively. Layer 1-2 has vias 221 on its respective top and bottom edges, while layer 5-6 has four rows of vias 223, 225, 227, 229 for establishing appropriate interconnections with layers on top and bottom of these respective layers 1-2, 5-6. The layer 5-6 center vias 225, 227 connect to the tip/ring pads 235 of layer 6 (FIG. 8) while the edge vias 223, 229 connect to the armature coil up/down driver signal paths 231 of layer 6. Layer 5-6 is laminated to layer 5, and layer 1-2 is laminated to layer 2.

Figure 7:
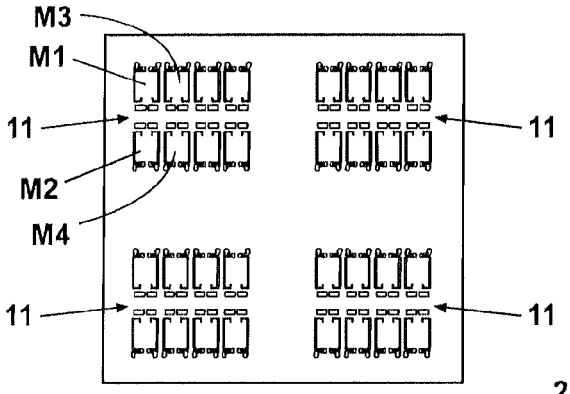
FIG. 7 illustrates a top view of a plurality of electromagnet assemblies according to an illustrative embodiment.

At this point in fabrication of the illustrative armature subassembly 40, the armature electromagnet assemblies are pre-routed, outlining individual electromagnets e.g. M1, M2, M3, M4, as shown in FIG. 7, each held together to the next within the panel by small tabs that are removed with final subsequent laser routing. FIG. 7 illustrates fabrication of four separate devices 11 on a common panel.

Figure 8A:
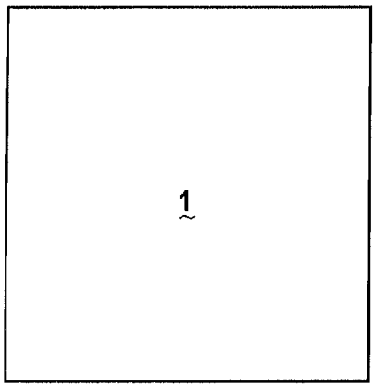
FIG. 8A is a top view of layer 1 of FIG. 3.
Figure 8B:
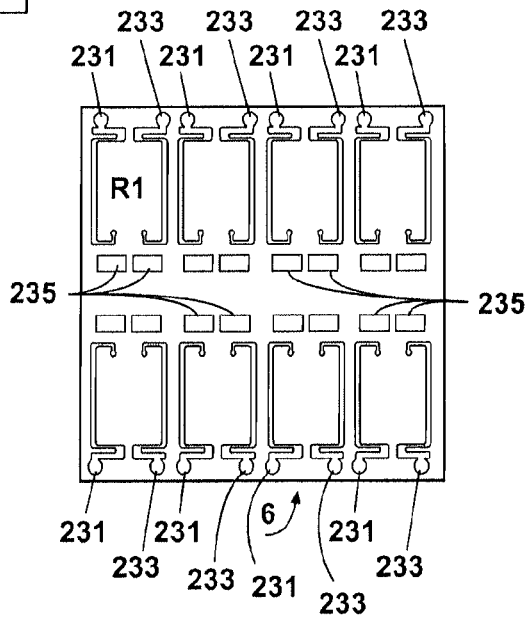
FIG. 8B is a top view of layer 6 of FIG. 3.

The final two layers 1, 6 of the armature subassembly 40 are shown in FIGS. 8A and 8B, respectively. After the pre-routing mentioned above, these layers 6, 1 are respectively laminated to layers 5-6 and 1-2 to complete the armature assembly. Layer 6 includes armature-in and armature-out conductors 231, 233 and flapper contact pads 235, which serve to short the tip and ring contacts, as discussed below. Layer 1 is simply a cover layer.

After the lamination of the last two layers 2, 6, the electrical contacts, e.g. 25, 27 are formed on the armature flappers. The contacts may be formed of various conductive materials, such as, for example, gold, nickel copper, or diamond particles.

Figure 9:
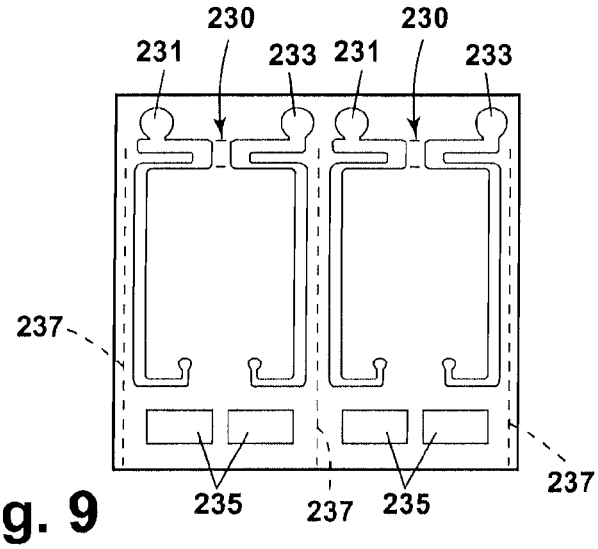
FIG. 9 is an enlarged view illustrating routing employed to create flexures or flappers according to the illustrative embodiment.

After contact formation, the armatures are laser routed to free the armatures for up and down movement held in place by their two flexures. Routing is done outside of the conductor lines as shown by dashed lines 237 in FIG. 9. As a result, an armature coil is positioned within each of the flexure lines 237. After these steps, the armature subassembly is attached to the lower ring frame layer 37 by laminating layer 6 to the ring frame layer 37.

Figure 12:
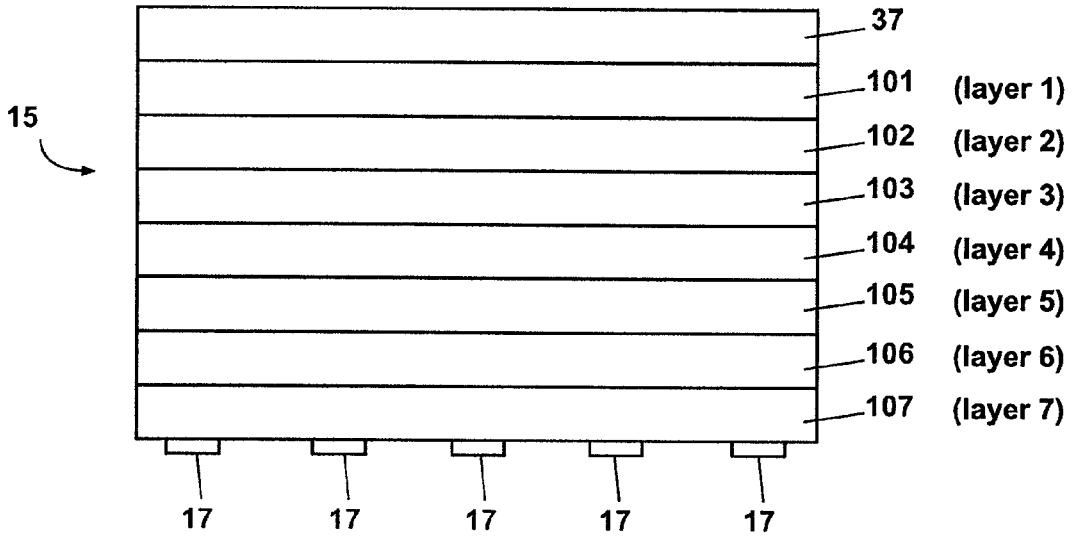
FIG. 12 is a schematic side view illustrating the positioning of the layers of an illustrative base subassembly embodiment.

In one illustrative embodiment, the base subassembly 15 comprises a stack of layers 101, 102, 103, 104, 105, 106, and 107, laminated together, as shown schematically in FIG. 12. Lamination of the base subassembly 15 and other layers may be done by a suitable adhesive such as "Expandex" or other well-known methods.

Figure 13:
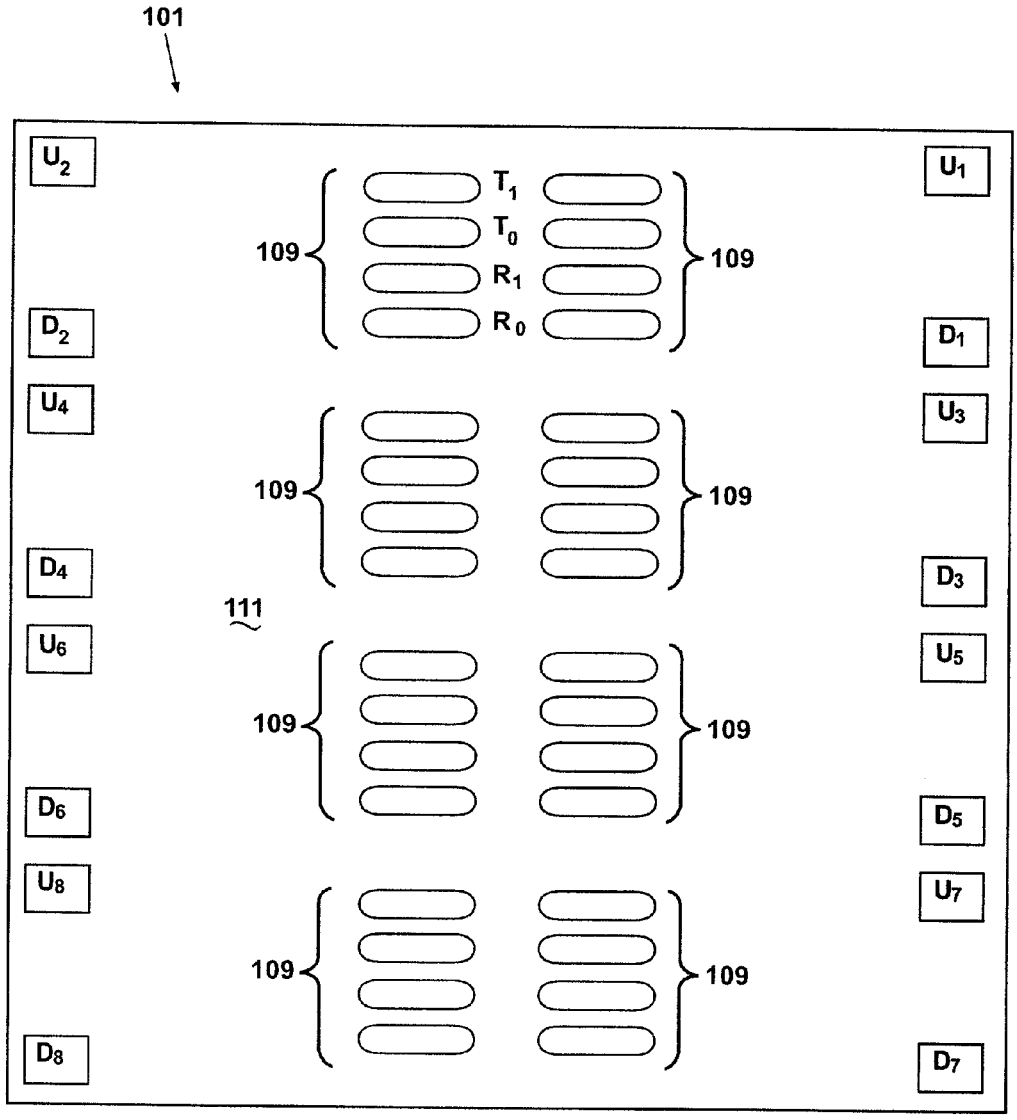
FIG. 13 is an enlarged view of the top layer of the base subassembly of FIG. 12.

An illustrative top layer 101 of the base subassembly 15 of an individual 2×4 switch matrix as shown in FIG. 2 is illustrated in FIG. 13. This layer contains eight sets of four electrical contacts disposed in a central region 111 of the layer. In the illustrative embodiment, each set 109 contains a "tip-in" contact, and an adjacent "tip-out" contact, as well as a "ring-in" contact and an adjacent "ring-out" contact. For example, the first set 109 of four electrical contacts contains tip-in and tip-out contacts $T_{1i}$, $T_{10}$ and ring-in and ring-out contacts $R_{1i}$, $R_{10}$. When a particular relay is activated, one of the flapper contact pads 235 shorts across the $T_i$, $T_O$ contacts, while the adjacent flapper pad 235 shorts across the $R_i$, $R_O$ contacts.

Along the top and bottom edges of the layer 101 are arranged conductor paths or "vias" through the layer 101 for supplying drive pulses to the armature coils, e.g. 41, 43 formed above the layer 101. For example, "up" conductor $U_1$ supplies input current to the coil of a first armature coil, while "down" conductor $D_1$ conducts drive current out of the first armature coil. Similarly, $U_3$, $D_3$; $U_5$, $D_5$; $U_7$, $D_7$; $U_2$, $D_2$; $U_4$, $D_4$; $U_6$, $D_6$; and $U_8$, $D_8$ supply respective "up" and "down" currents to each of the respective seven other armature coils.

Top base subassembly layer 101 may be formed in one embodiment of an insulator such as polyimide glass with, for example, copper, tin or other suitable electrical conductor materials. Polyimide glass substrates plated with plated copper layers may be patterned with photo resist and etched to create the desired contact and/or conductor patterns of the base subassembly layers. The other layers of the device 11 may be similarly fabricated.

Figure 14:
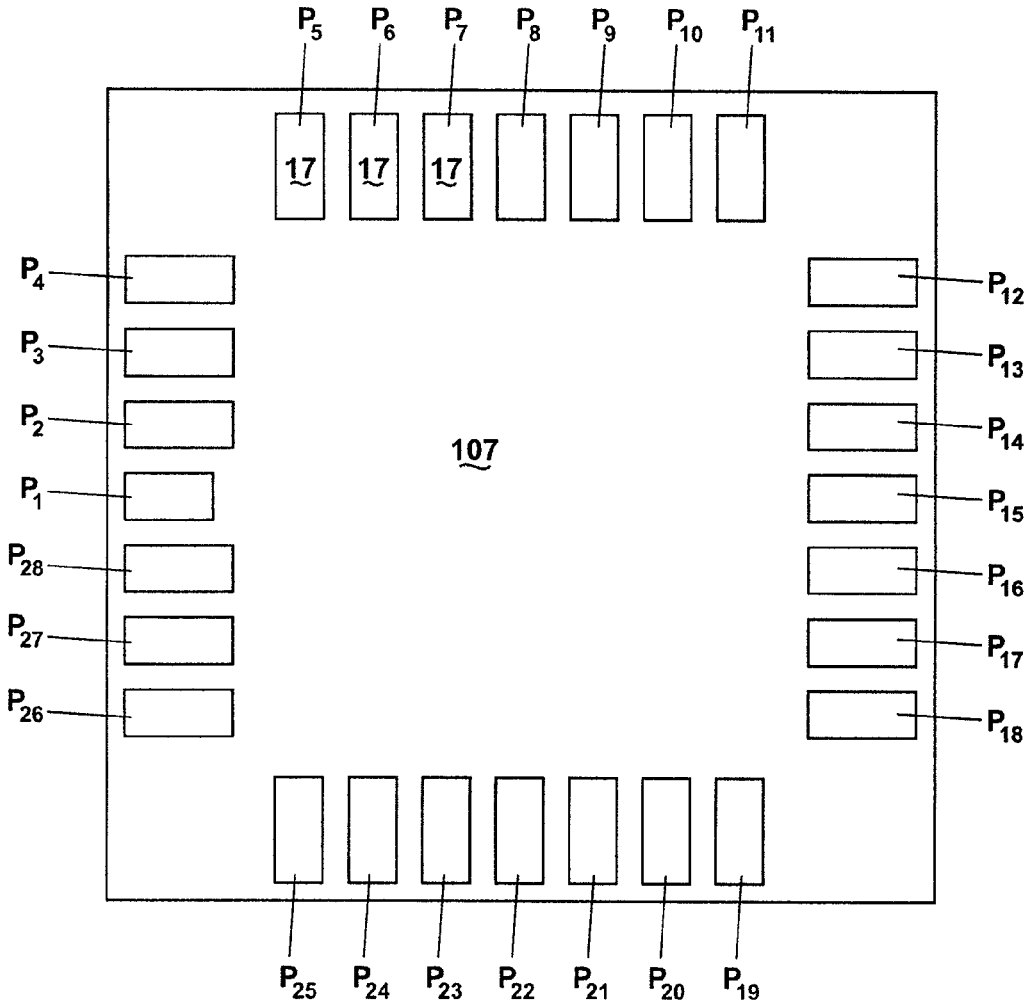
FIG. 14 illustrates the bottom layer of the base subassembly of FIG. 12.
Figure 15A:
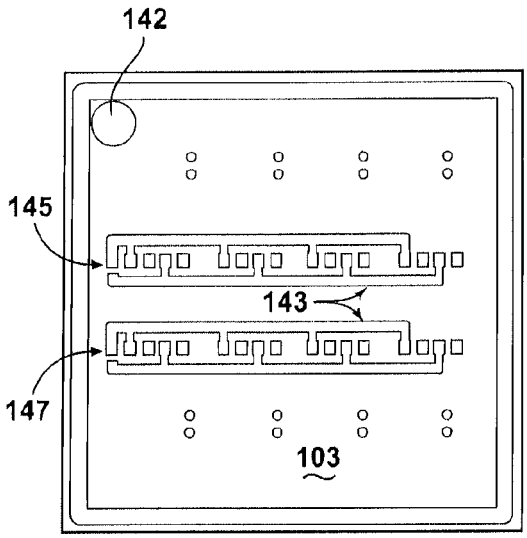
FIG. 15A is a top view of a third intermediate base subassembly layer.
Figure 15B:
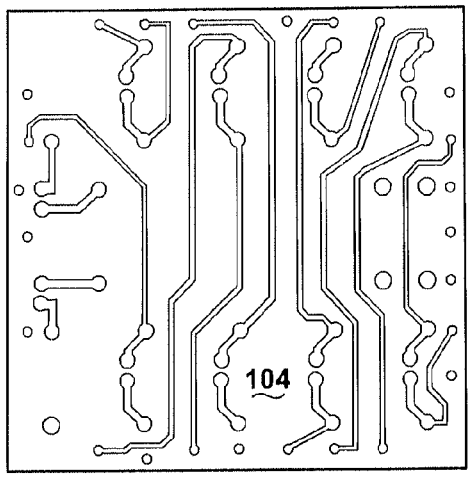
FIG. 15B is a top view of a fourth intermediate base subassembly layer.
Figure 15C:
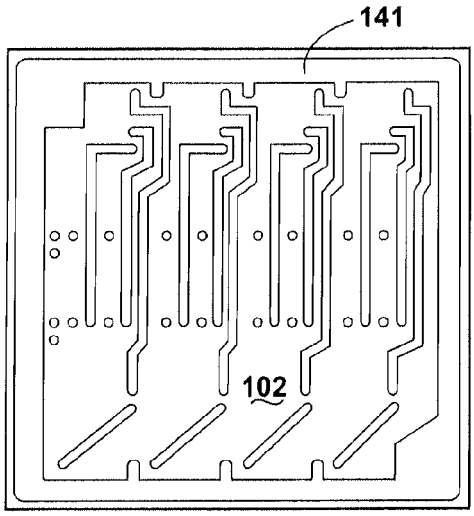
FIG. 15C is a top view of a second intermediate base subassembly layer.
Figure 15D:
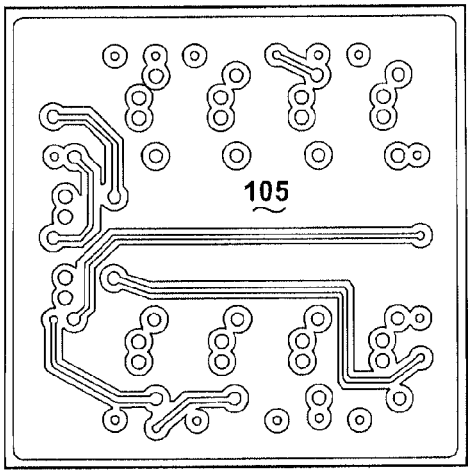
FIG. 15D is a top view of a fifth intermediate base subassembly layer.

The remainder of the base subassembly 15 comprising layers 102 (FIG. 15C), 103 (FIG. 15A), 104 (FIG. 15B), 105 (FIG. 15D), 106, and 107 is concerned with routing signals from the tip and ring pads, e.g. $T_{1i}$, $T_{1o}$, $R_{1i}$, $R_{1o}$, through the device to the exterior contacts 17 of the bottom base subassembly layer 107 and routing drive current to and from the armature supply conduits, $U_1$, $D_1$; $U_2$, $D_2$; $U_3$, $D_3$, etc. FIG. 14 illustrates the bottom base subassembly layer 107 and the pin assignments of contacts 17 in more detail, to assist in illustrating the signal routing through the base subassembly 15 of the illustrative embodiment.

The pad assignments for the embodiment shown in FIG. 14 are as follows:

| Pad Signals Assignments Table | |
|---|---|
| $P_1$ | $C_0$ Ring - in |
| $P_2$ | Common (coil control) |
| $P_3$ | Coil 1 Input |
| $P_4$ | $C_0$ Tip - in |
| $P_5$ | Tip - out O |
| $P_6$ | Ring - out O |
| $P_7$ | Coil 3 input |
| $P_8$ | Common |

-continued

| Pad Signals Assignments Table | |
|---|---|
| $P_9$ | Tip out 2 |
| $P_{10}$ | Coil 5 input |
| $P_{11}$ | Ring - out 2 |
| $P_{12}$ | Common |
| $P_{13}$ | Coil 7 input |
| $P_{14}$ | Common |
| $P_{15}$ | C1 Tip - in |
| $P_{16}$ | Common |
| $P_{17}$ | Coil 8 input |
| $P_{18}$ | C1 Ring - in |
| $P_{19}$ | Ring out 3 |
| $P_{20}$ | Tip - out 3 |
| $P_{21}$ | Coil 6 input |
| $P_{22}$ | Common |
| $P_{23}$ | Ring - out 1 |
| $P_{24}$ | Coil 4 input |
| $P_{25}$ | Tip out 1 |
| $P_{26}$ | Common |
| $P_{27}$ | Coil 2 input |
| $P_{28}$ | Common |

It will be appreciated from the pin assignments that all of the "down" armature coil supply conduits $D_1$, $D_2$, $D_3$, $D_4$, $D_5$, $D_6$, $D_7$, $D_8$ are connected in common. In this connection, the layer 102 of FIG. 15C includes a metallization border 141 forming a common ground plane for the armatures. Layer 103 of FIG. 15A includes a post 142 which connects the common plane to pin 2. Layer 105 of FIG. 15D includes traces and vias to the pin outs on layer 7.

Additionally, it will be seen from the pad assignments in the Table above that there is one pair of tip and ring conductor outputs for relays $R_1$ and $R_2$, one pair for $R_3$ and $R_4$, one pair for $R_5$ and $R_6$, and one pair for $R_7$ and $R_8$. There are also two pairs of tip and ring inputs ($C_0$ Ring—in, $C_0$ Tip—in, C1 Tip—in, C1 Ring—in). Thus, in the illustrative embodiment, only two of the relays of the 2×4 matrix (one odd, one even) may be closed at the same time. The metallization pattern of layer 103 of FIG. 15A reflects this tip and ring interconnection scheme. In particular, the central metallization 143 comprises two rows 145, 147 wherein the top row provides tip and ring interconnections for the row "1" tip and ring inputs and the bottom row provides the tip and ring interconnections for the row "2" tip and ring inputs, thus illustrating how the tips and rings are connected in common. The manner of interconnection is such that connecting opposite row 1 and row 2 switches, e.g. $R_1$ and $R_2$ in FIG. 2, creates a short. In one illustrative embodiment, software control prevents such shorts.

Figure 16:
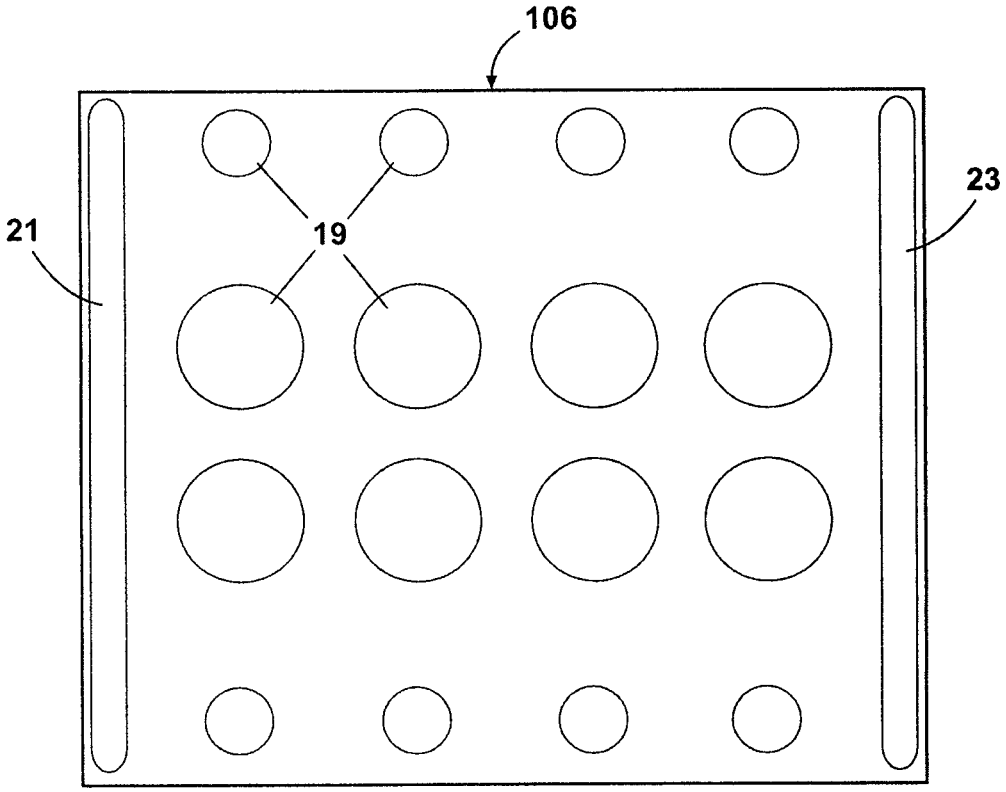
FIG. 16 illustrates the iron post layer of the base subassembly of FIG. 12.

The iron post layer 106 of the base subassembly is further illustrated in FIG. 16. As shown, eight large and eight small cylinders are drilled and two end strips are routed out of layer 106 and are filled with an iron powder epoxy mix to form the iron posts 19 and iron strips 21, 23 that channel the magnetic force of the bottom magnet 13 toward the armatures' flappers 25, 27 and the armature rear ends 29, 31. Suitable vias (not shown) are formed in layer 106 to transmit signals between the layers 105 and 107. Thereafter, the layer 106 is laminated between layers 105 and 107 to complete the base subassembly. In one embodiment, layer 106 may be, for example, 16 mils thick, while the large and small cylinders are 64 mils and 30 mils in diameter respectively. Layers 102, 103, 104, 105 of FIGS. 15C, 15A, 15B, and 15D may be, for example, 2 to 3 mils thick. The lower ring frame layer 37 is laminated to the first base subassembly layer 101.

Figure 10A:
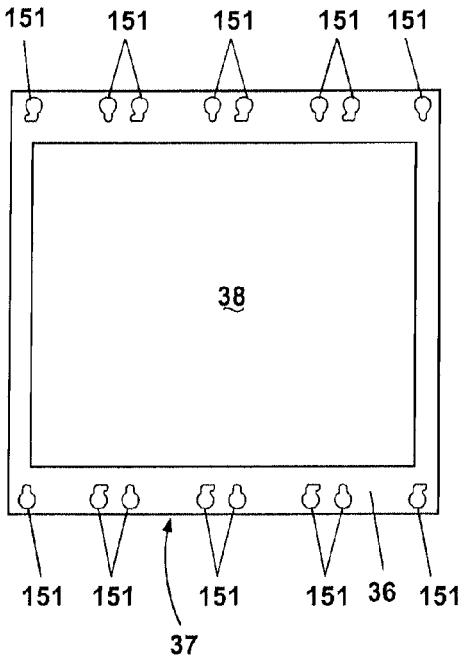
FIG. 10A is a top view of ring frame layer 37 of FIG. 1.
Figure 10B:
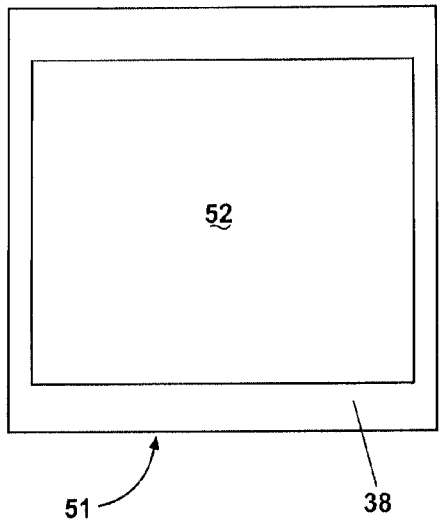
FIG. 10B is a top view of ring frame layer 51 of FIG. 1.

The upper and lower ring frames 37, 51 are further illustrated in FIGS. 10A and 10B, respectively. In one embodiment, they are 8 and 5 mils thick respectively. The lower ring frame 37 has appropriate vias 151 for conducting the armature drive signals, while the upper ring frame 51 has no vias. The rectangular space 38, 52, within each of the borders 36, 38 of the respective frames 37, 51 are hollow.

Figure 11:
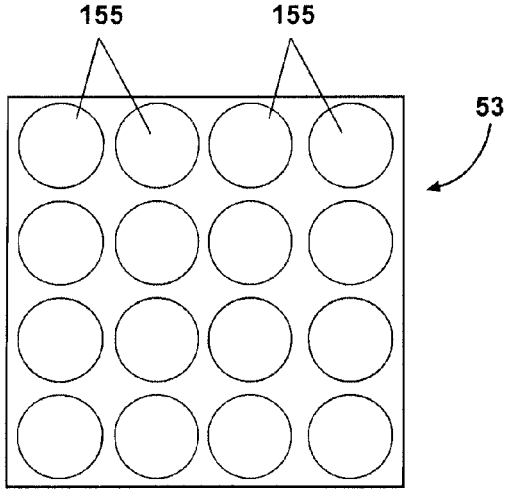
FIG. 11 illustrates the top iron post layer of FIG. 1 in more detail.

The upper iron post layer 53 is illustrated further detail in FIG. 11. It comprises 16 small cylinders, e.g. 155, drilled and filled with an iron powder epoxy mix to form iron posts that channel the magnetic force of the top magnet 57 toward the armature subassembly 40.

Figure 17:
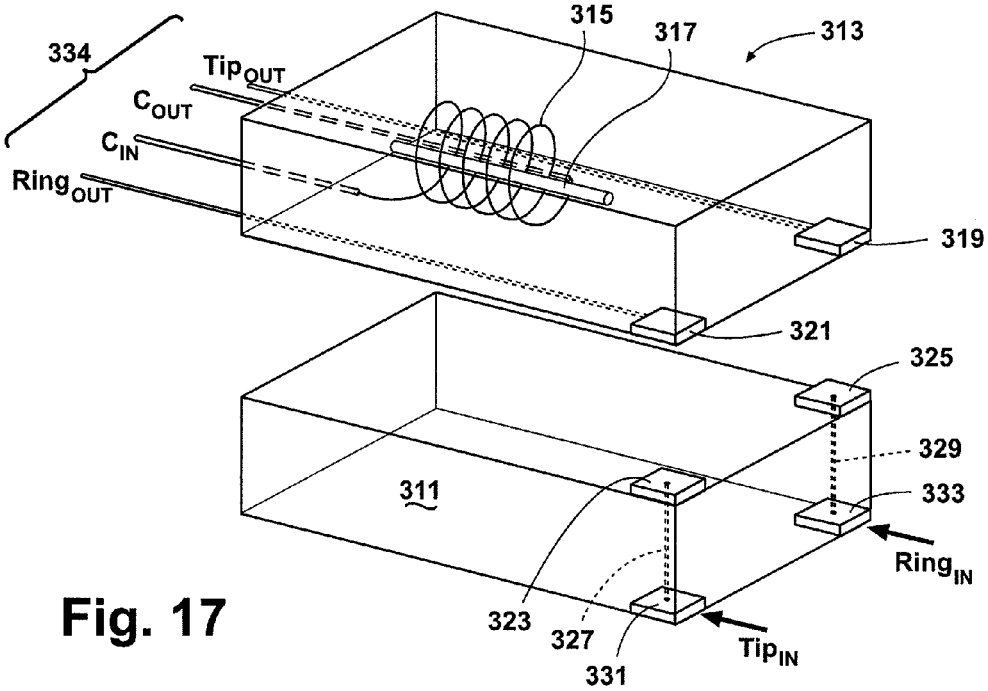
FIG. 17 is a perspective schematic view of an embodiment employing a conductor hinge.

FIG. 17 shows an armature block 313 positioned above a base 311 according to an alternate embodiment. FIG. 17 is presented in a somewhat simplified schematic form to illustrate various principles of operation and structural aspects of the illustrative embodiments. The armature 313 and base 311 each comprise a number of laminated layers as discussed hereafter in more detail.

The layers of the armature block 313 form a coil 315 around a core 317, thereby forming an electromagnet, for example as described in connection with FIGS. 4 and 5. Two coil conductor segments $C_{in}$ and $C_{out}$ extend from the bottom edge of the armature block 313. Adjacent the coil conductor segments $C_{in}$ and $C_{out}$ are positioned parallel tip and ring conductor segments $TIP_{out}$ and $RING_{out}$. These conductors $TIP_{out}$, $RING_{out}$ comprise part of the bottom most layer 316 of the armature block 313 and continue across that layer 316 (FIG. 18) to electrically connect with tip and ring conductor pads 319, 321 disposed on the opposite lower front edge of the armature 313. In the illustrative embodiment, the four adjacent parallel conductors $C_{in}$, $C_{out}$, $TIP_{out}$, $RING_{out}$, are employed to form a hinge which positions the armature 313 in a generally horizontal position and enables it to pivot toward the base 311 and thereafter return to the horizontal position as hereafter described.

The base 311 includes tip and ring upper conductor pads 323, 325 disposed on its front top surface corners to make electrical contact with the armature pads 319, 321 when the pivotable armature 313 moves downwardly toward the base 311. Conductive vias 327, 329 constructed through the various base layers connect the upper base conductor pads 319, 321 to the $RING_{in}$ and $TIP_{in}$ conductor pads 331, 333. In operation, the armature coil is activated in one polarity to pull the armature toward a top magnet, thereby positively holding the contacts opened and is activated in an opposite polarity to pull the armature towards a bottom magnet to positively close and hold the contacts 321, 319; 323, 325 in a closed conductive interconnection.

Figure 18:
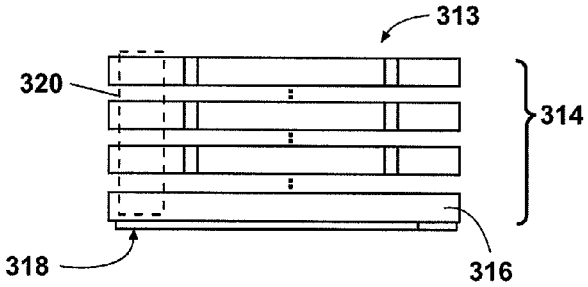
FIG. 18 is a side schematic view illustrating fabrication of a conductor hinge.

FIG. 18 schematically illustrates the manner in which a conductor hinge is fabricated according to one embodiment. First, the armature layers 314 including the bottom layer 316 are all laminated together, for example, using a suitable glue or adhesive, and thereafter an end most portion of each armature layer 314 is removed to leave an edge 318 of the bottom conductor layer 316 exposed. The dashed line 320 in FIG. 18 encompasses the end portions of the armature layers which are removed. The non-conductive portions of the edge 318, including portions between the conductors $C_{in}$, $C_{out}$, $TIP_{out}$, $RING_{out}$, are then laser routed out to leave only the four rectangular conductor segments 334 extending from the edge of the armature block 313, as schematically shown in FIG. 17.

Figure 19:
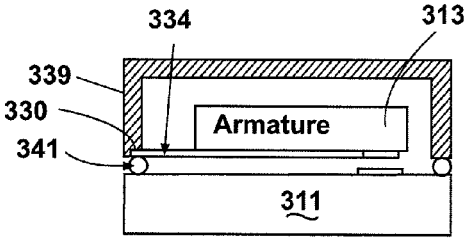
FIG. 19 is a side schematic view illustrating the interface between the conductor hinge and a base portion of a device.
Figure 22:
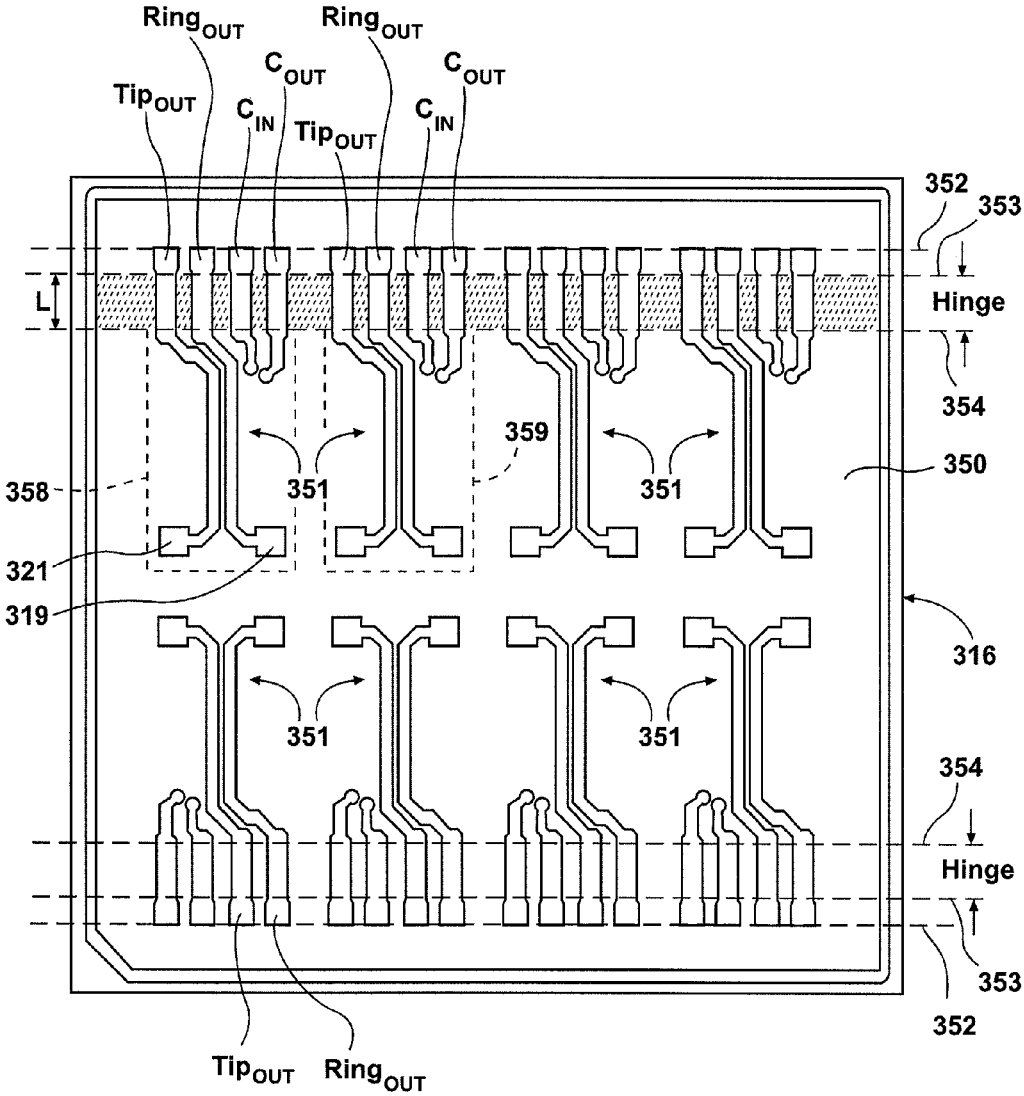
FIG. 22 is a bottom view of the bottom most layer of an alternate armature assembly embodiment.

As shown schematically in FIG. 19, the end most edges 330 of the four conductor segments 334 are captured or "pinched" between the base 311 and an upper housing 339, which is attached by a glue layer 341, of, for example, Ex Spandex, which glue layer may be 2 mils thick and which layer spaces the armature 313 slightly apart from the base layer 311. In other embodiments, another lamination layer comprising a rectangular ring, for example, could be placed between the glue layer 341 and the base 311 as a spacer. In one embodiment, the conductor segments 334 may each be 5 mils wide traces of ½ oz. rolled annealed copper or flex copper, each about 25 mils in length "L" (FIG. 22). Such dimensions may of course vary in alternate embodiments. Thus, the armature 313 is suspended within an interior cavity of the laminated structure by conductor hinges comprising the four conductor segments 334.

Figure 20:
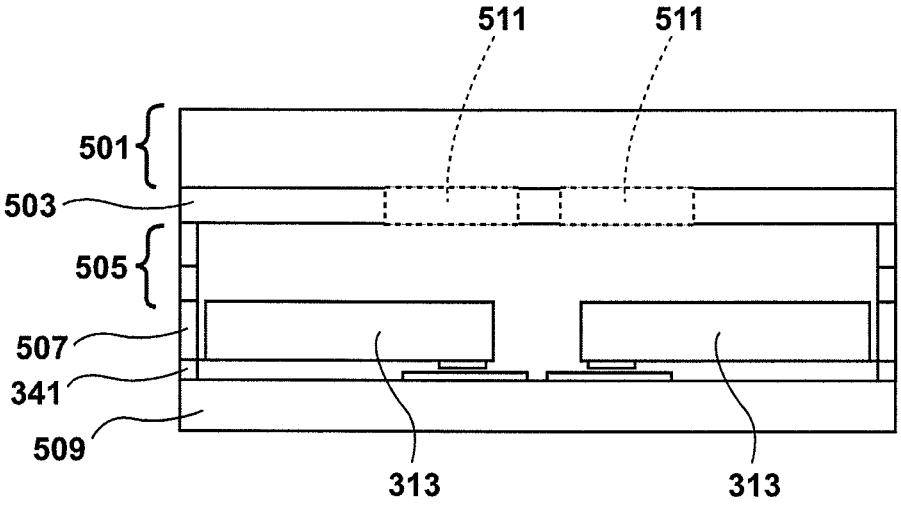
FIG. 20 is a side view of an alternate embodiment of a switch or relay.
Figure 21:
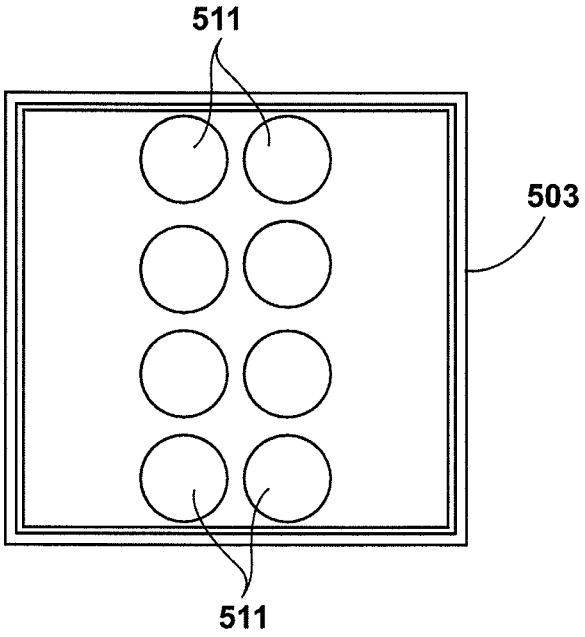
FIG. 21 is a top view of an iron post layer of the embodiment of FIG. 20.

The armature and/or base layer structures may be adapted for use in various embodiments of a relay, for example, as shown in FIG. 1, further comprising in certain embodiments top and/or bottom magnets and other structural layers. Another such embodiment is illustrated in FIGS. 20 and 21 and comprises a routed magnet frame 501, an iron post layer 503, a ring frame or spacer 505, an armature assembly layer 507 and a base assembly 509. As shown in FIG. 21, the iron post layer 503 comprises eight small cylinders 511 filled with iron powder epoxy mix to form iron posts which channel the top magnetic force toward the front ends of the armatures 313. Top and bottom magnets 13, 15 as employed in FIG. 1 are also employed in the embodiment of FIG. 20.

FIG. 22 illustrates an embodiment of the bottom surface 350 of an armature bottom most layer 316 wherein eight relays $R_1$, $R_2$, $R_3$, $R_4$, $R_5$, $R_6$, $R_7$ and $R_8$ are formed in a single device or switch. Accordingly, a respective bottom conductor trace 351 is formed for each of the relays. In the illustrative embodiment, each trace 351 is identical in width, similar in shape and includes a $TIP_{out}$ and $RING_{out}$ contact pad, a $COIL_{in}$ input and a $COIL_{out}$ output, and conductor pads 319, 321, as illustrated in connection with FIGS. 17-19. The opposite side (top surface) of layer 316 comprises vias which extend through the layer 316 to provide conductor paths to the armature coil inputs, e.g. $C_{in}$, $C_{out}$.

Figure 30:
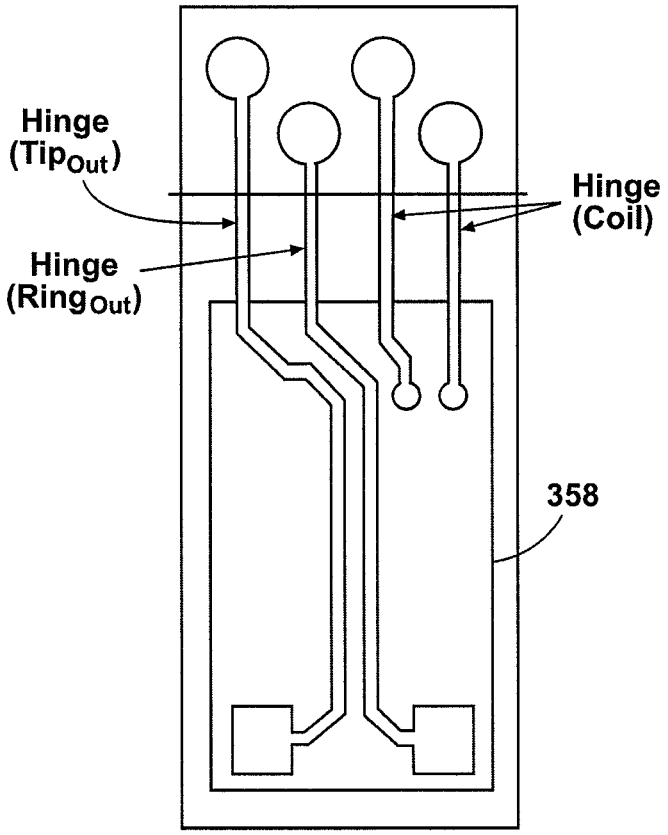
FIG. 30 is a bottom view of an alternate layout of a conductor trace.

In FIG. 22, the portions of the conductor traces 351 of slightly enlarged width which lie between the dashed lines 352 and 353 are sandwiched between adjacent laminated layers to attach each armature to a side edge of the device as shown in FIG. 19. The portions of the conductor traces 351 which lie between the dashed lines 353 and 354 comprise the hinge portions which extend into the device cavity and flex to allow the armature 313 to move up and down so as to open and close the tip and ring contact pairs, e.g. 321, 323; 319, 325. Crosshatched non-metallic portions between the conductor hinge elements are removed by laser routing, for example, using a $CO_2$ laser which will cut the non-metallic portions, but not the metallic conductor portions. After all of the armature layers are laminated together, mechanical and laser routing, e.g., around paths 358, 359 is performed to remove portion 320 of FIG. 18 and otherwise define the contours of the individual suspended armature 313 of each device $R_1 \ldots R_8$. In one embodiment, the traces 351 may be etched copper which is thereafter gold plated. Various other conductive materials can be used to form the traces 351 as will be apparent to those skilled in the art. An alternate layout of a conductor trace 351 is shown in FIG. 30.

Figure 31:
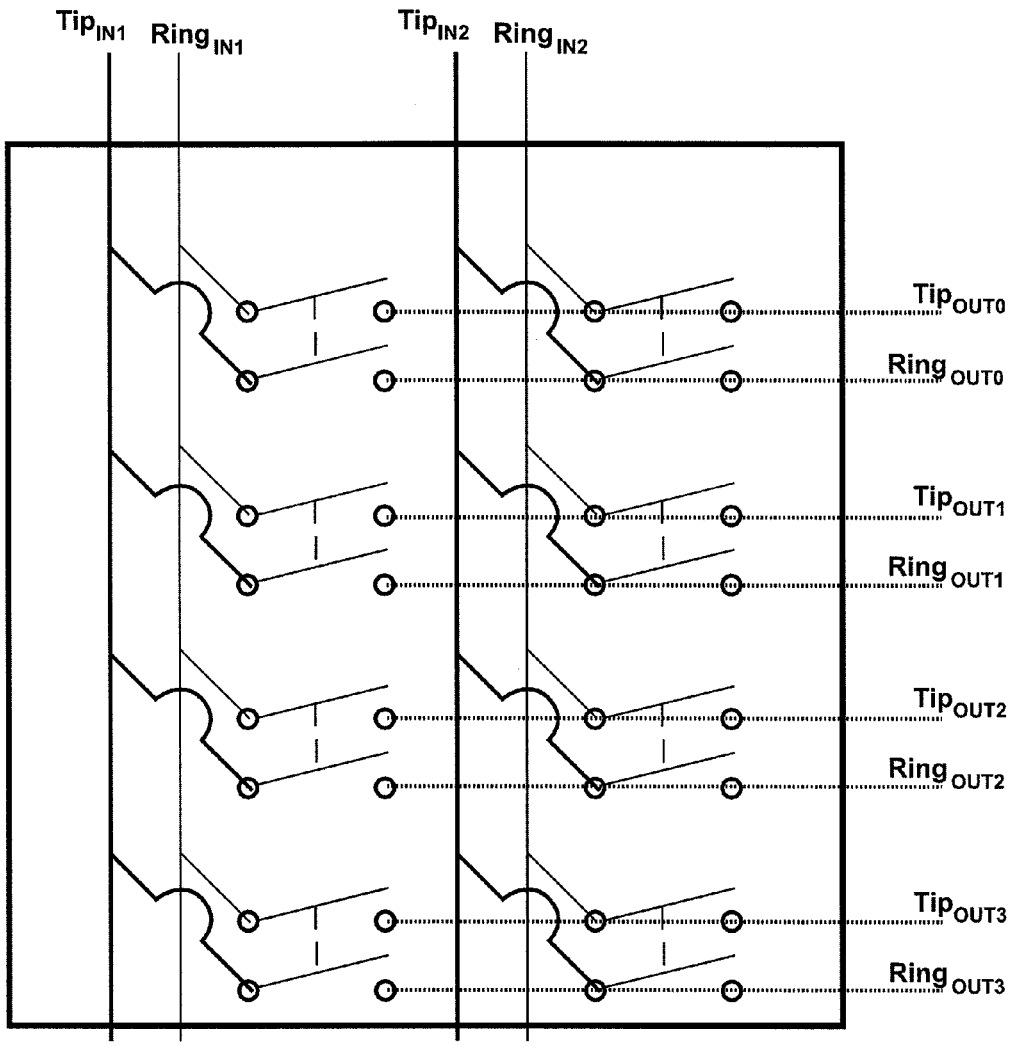
FIG. 31 is a schematic view of a 2×4 switch matrix.
Figure 32:
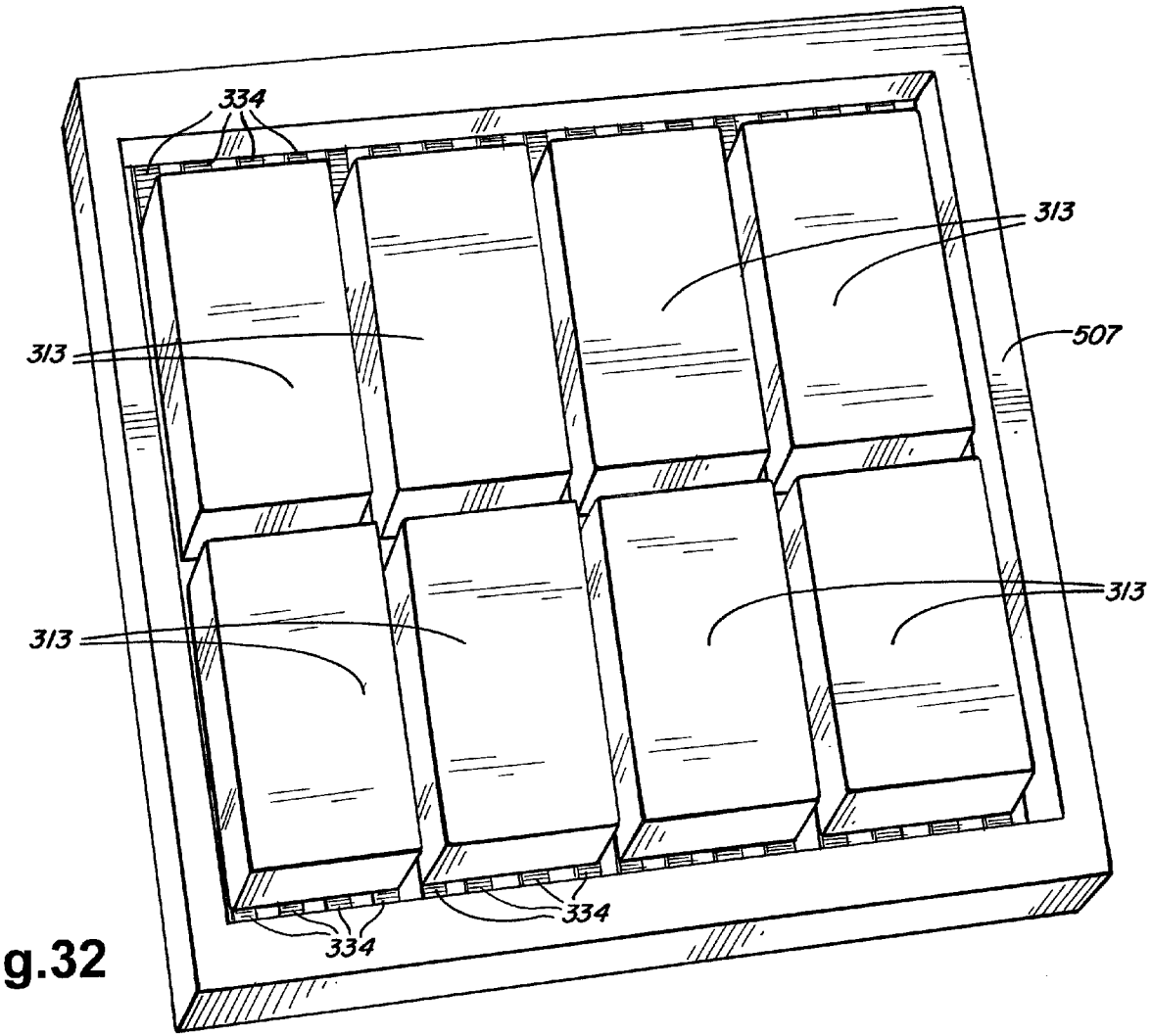
FIG. 32 is a top perspective view of a device having eight conductor hinge suspended armatures.
Figure 33:
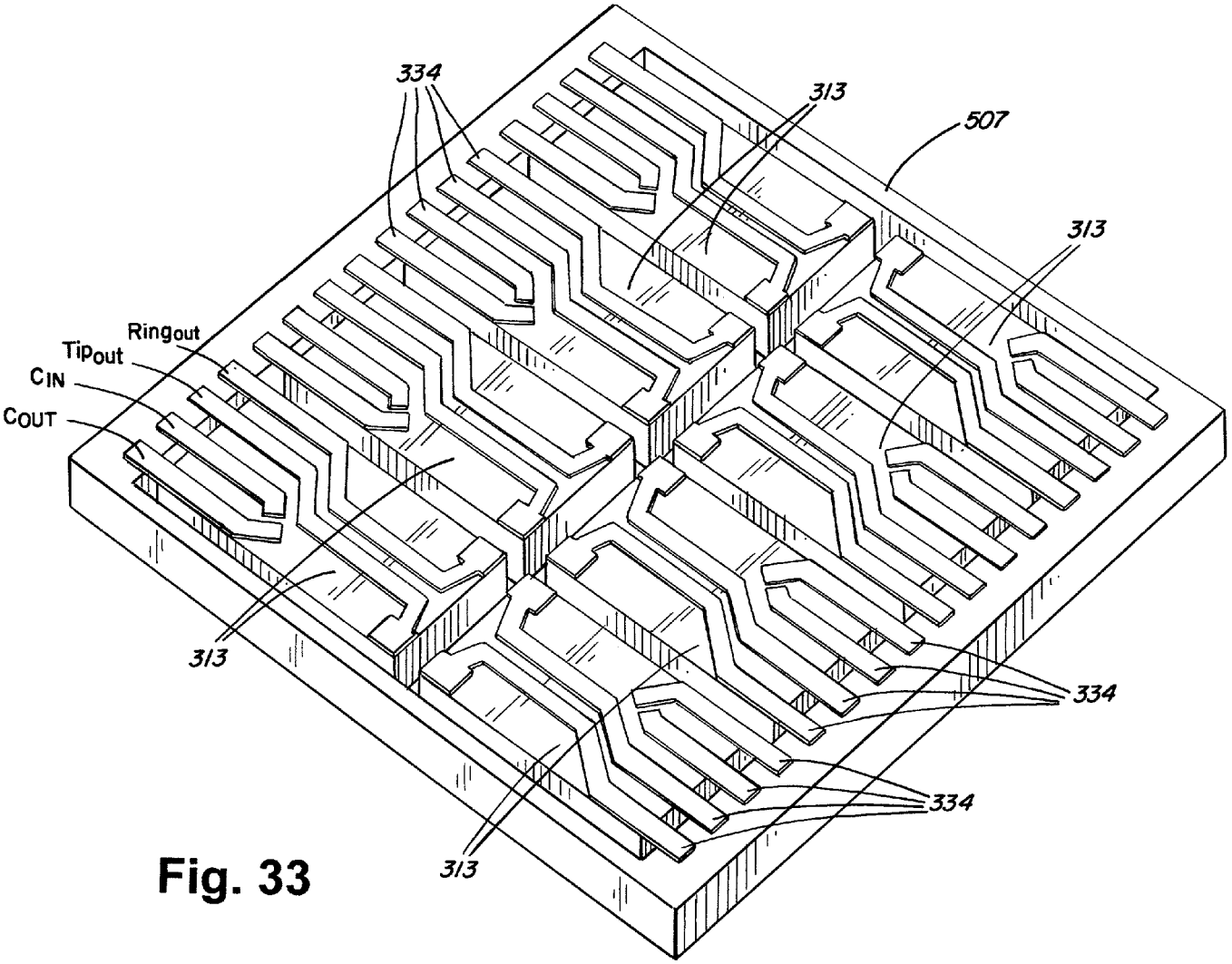
FIG. 33 is a bottom perspective view of the device of FIG. 32.

Layer 316 is laminated together with layers which may be constructed according to principles illustrated in connection with FIGS. 4 and 5 to form eight two-coil electromagnets disposed above each trace 351. Thereafter, mechanical and laser routing are used to cut out and define eight individual armatures 313 pivoted from the edges of the device by a respective conductor hinge 334, as shown in FIGS. 30 and 31. As will be appreciated, in the embodiment under discussion, each of the outer and inner armature coils of each electromagnet receive input drive current from the same respective COI- $L_{in}$ input and are connected at their output ends to a single one of the respective $COIL_{out}$ outputs.

Figure 23:
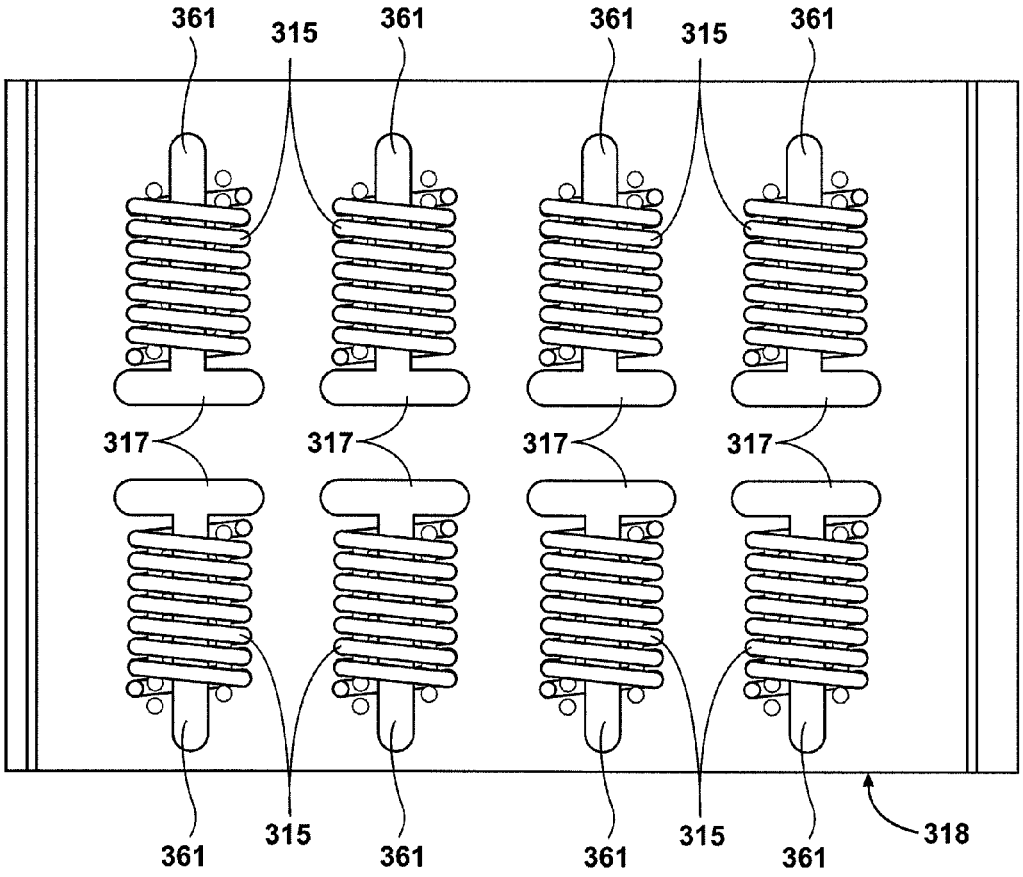
FIG. 23 is a top view illustrating an alternate magnet core embodiment.

An alternate construction of an armature electromagnet iron core layer 318 is shown in FIG. 23. In this embodiment, the eight iron cores 317 are "T"-shaped, thereby increasing the amount of core material as much as possible without interfering with other circuitry. To fabricate a T-shaped core layer 317, a T-shaped cavity is routed out of the substrate and thereafter filled with the viscous iron powder epoxy material. As indicated, the armature coils 315 are formed around the elongated central iron core portions 361, employing, for example, structure like that taught in conjunction with FIGS. 4 and 5, while the horizontal "cross" portion of each "T" shaped core 317 lies outside its respective coil 315.

Figure 29:
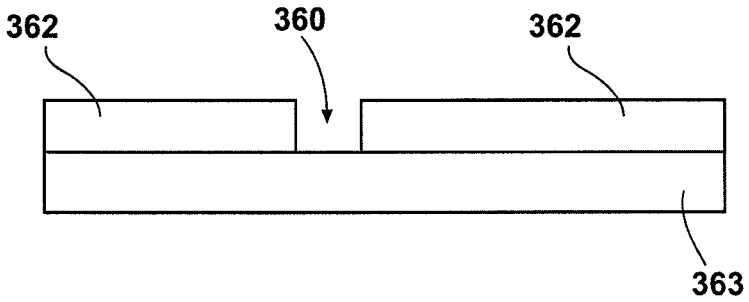
FIG. 29 is a side view useful in illustrating fabrication of a magnet core according to an illustrative embodiment.

In one embodiment, the iron filler material used to form the cores 317 may be a blend of 1-4 micron and 4-6 micron Carbonyl Iron blended with a high viscosity low solids polyimide resin. The blend results in a 90% iron blend that is then screened into the slots or cavities to make the iron fill for the armature and the iron posts of illustrative embodiments. The high concentration of iron results in cores which are highly magnetic. In one embodiment, a cavity 360 is formed entirely through one armature layer 362 and a second armature layer 363 is then attached by lamination below that layer 362, as shown in FIG. 29. Thereafter, a suitable iron/resin mix is screened or otherwise introduced to fill the cavity 360. Layer 362 may be, for example, 24 mils thick in one embodiment. Where the layer 362 comprises a polyimide layer, a polyimide resin is used for adhesion. If the layer is formed of FR4 PCB material, a different resin or adhesive may be used. In other embodiments, alternative iron fill mixtures which can be screened-in may be used, as well as solid sheet magnetic material cut to fit.

An embodiment of a base 311 for the operation with the armature layer 316 of FIG. 22 is illustrated in FIGS. 24-28. This base 311 includes six main layers and, in contrast to the embodiment of FIG. 1, does not include a magnetic post layer. The overall function of the base 311 is to interconnect the tip and ring inputs and outputs in a 2×4 matrix switch accessible at the pads of the bottom most layer, e.g. layer 107 of FIG. 14. Such a matrix is illustrated schematically in FIG. 31. As shown, each $TIP_{in}$, $RING_{in}$ input pair may be connected to any one of four output pairs $TIP_{out0}$, $RING_{out0}$; $TIP_{out1}$, $RING_{out1}$; $TIP_{out2}$, $RING_{out2}$; or $TIP_{out3}$, $RING_{out3}$. A 2×4 matrix switch is useful because of its scalability, but matrices of various other ratios of inputs to outputs can be fabricated according to the principles herein disclosed.

Figure 24:
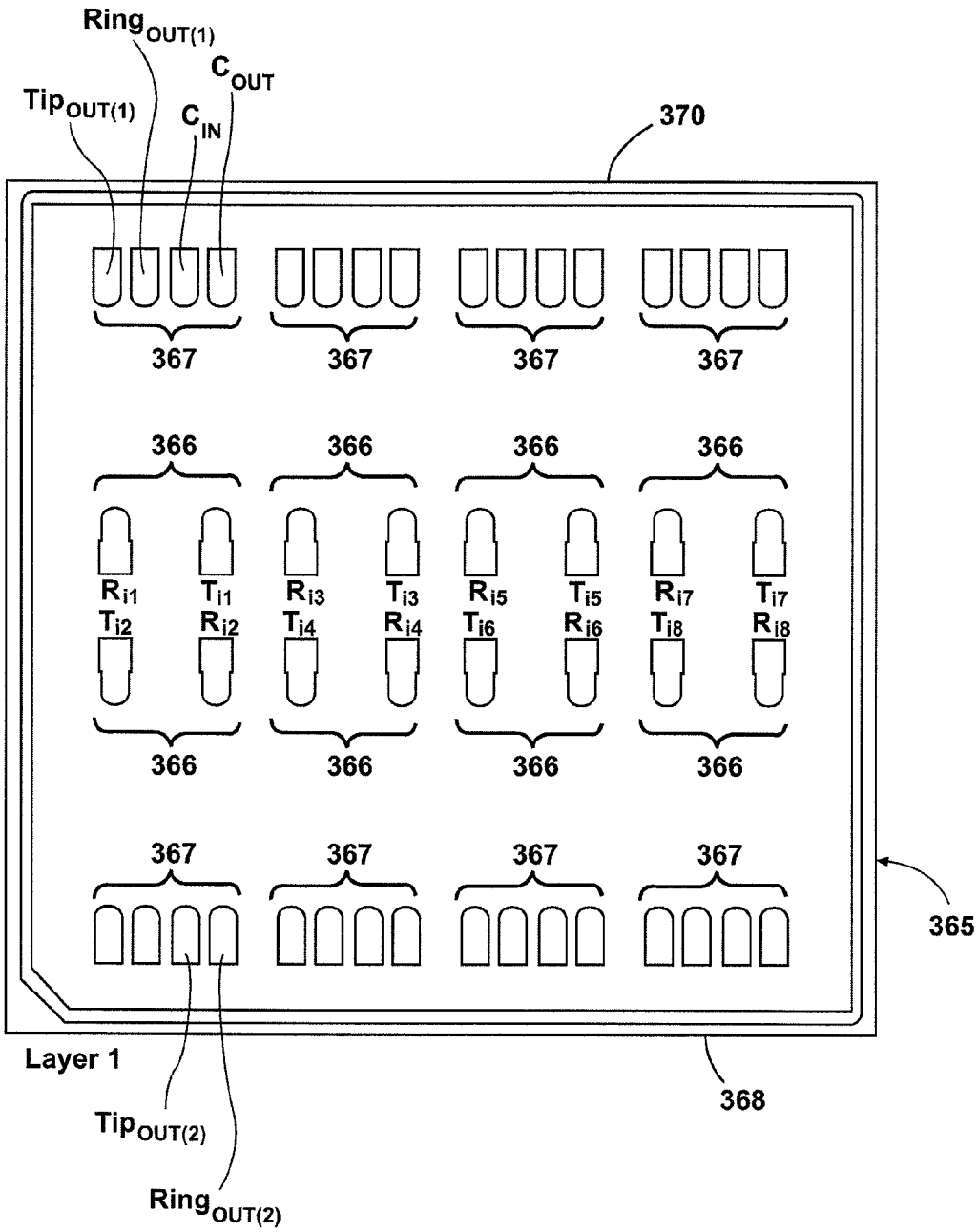
FIG. 24 is a top view of a first base layer of an alternate base embodiment.

The top surface of the first laminated layer 365 of the base 311 is illustrated in FIG. 24 and includes respective contact pad pairs 366, each pair corresponding to a pair of contacts 323, 325 of FIG. 17, wherein each pair 323, 325 serves to contact a respective pair of armature pad contacts 319, 321 of each of the eight respective armatures $R_1 \ldots R_8$. The groups of four conductors 367 along each of the opposite edges 368, 370 of the first layer 365 are vias extending through layer 365, which establish respective conductive signal paths through the layer 365 to the $TIP_{out}$, $RING_{out}$, $COIL_{in}$ and $COIL_{out}$ conductors pads located between dashed lines 352 and 353 of the lowermost armature layer 316 of FIG. 20. Vias also extend through layer 365 from its back surface to each of the conductor pads 366. The conductor pads 366, 367 may be tin plated or may comprise various other conductive metals or materials.

Figure 25:
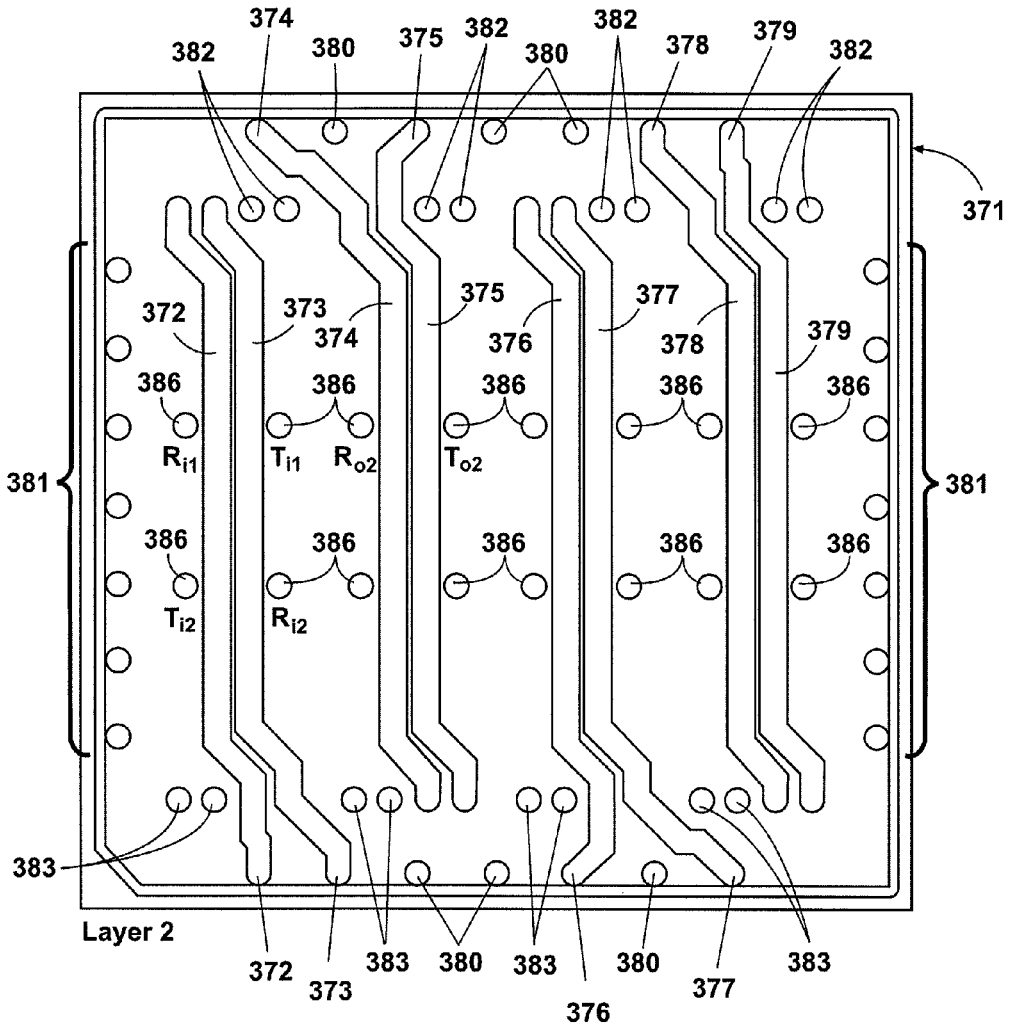
FIG. 25 is a top view of a second base layer of the embodiment of FIG. 24.

The top surface of the second base layer 371, illustrated in FIG. 25, lies directly below the first layer 371, is laminated thereto, and includes a number of conductor traces and vias. The long, generally vertical conductor trace 372 establishes electrical contact with the $TIP_{out}$ (1) pad and $TIP_{out}$ (2) pad of layer 365 of FIG. 24 and to a via leading to a bottom layer output pad, e.g. pad $P_{25}$ of FIG. 14. Similarly, the generally parallel conductor trace 373 establishes electrical contact with the $RING_{out}$(1) pad and $RING_{out}$(2) pads of layer 365 and to a via leading to a bottom layer pad such as pad $P_{24}$ of FIG. 14. The remaining pairs of generally vertical parallel traces 374, 375; 376, 377; 378, 379 perform the same function with respect to the remaining tip and ring pairs of layer 365 and output pads $P_5$, $P_7$; $P_{21}$, $P_{19}$; $P_{10}$, $P_{11}$ of FIG. 14.

The vias 381 along either vertical side edge of layer 371 of FIG. 23 are each disposed above a respective one of the contact pads along the respective side edges of the bottom layer, e.g. layer 107 of FIG. 14. The remaining vias 386 in the central region of layer 371 each communicate conductively with a respective one of the contact pads 366 of layer 365 of FIG. 24. Vias 382, 383 conduct the coil drive signals $C_{in}$, $C_{out}$ to each armature coil.

Figure 26:
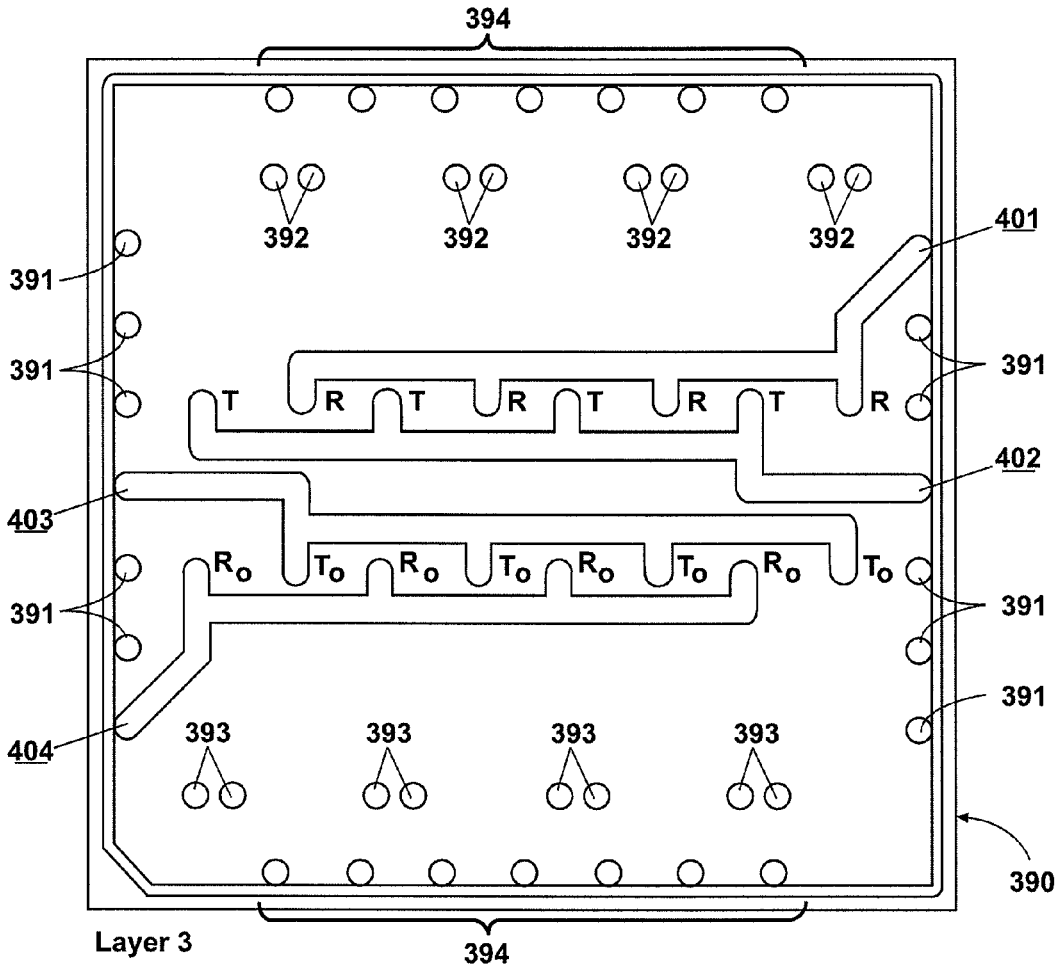
FIG. 26 is a top view of a third base layer of the embodiment of FIG. 24.

The top surface of third base layer 390, shown in FIG. 26 lies directly below the second base layer 371, is laminated thereto, and includes a number of conductor traces and vias. Four generally horizontally disposed elongated conductor traces 401, 402, 403, 404 are formed in the central region of the third layer 390. The first trace 401 conductively interconnects each upper row $RING_{in}$ contact pad 366 of FIG. 24 through respective vias 386 (FIG. 23) in common and to one of the vias 381 leading to, e.g., contact pad $P_{12}$ of the base layer of FIG. 14. Similarly, each lower row $RING_{in}$ contact pad 366 is connected in common via the trace 404 to one of the vias 381, leading to, e.g., contact pad $P_{26}$ of the bottom layer 107 of FIG. 14. The remaining two traces 402, 403 similarly respectively connect in common the upper and lower $TIP_{in}$ contact pads 366 through vias 381 to a selected output pad, e.g. $P_1$, $P_{15}$ of FIG. 14. Vias 392, 393 conductively communicate with vias 382, 383 of the second layer 371 (FIG. 25) to conduct the coil drive signals. Vias 394 along the top and bottom horizontal edges of the third layer 390 are each disposed above a respective conductor pad of the base layer 107.

Figure 27:
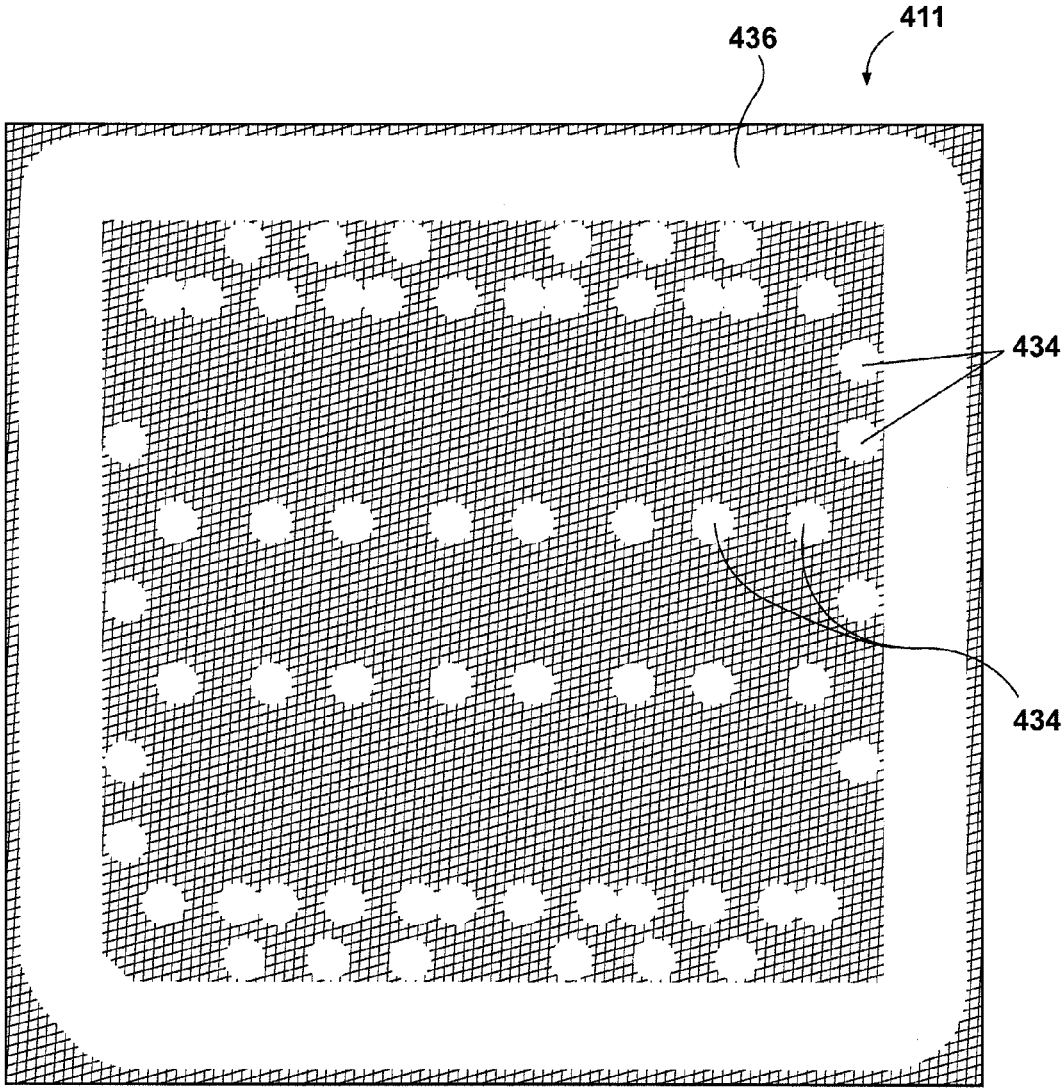
FIG. 27 is a top view of a ground plane layer of the alternate base embodiment.

The top surface of fourth base layer 411, illustrated in FIG. 27, is a ground plane layer which lies directly below the third layer 391 and is laminated thereto. As those skilled in the art will appreciate, the crosshatched area of layer 411 comprises a ground or common conductor region to which the "coil out" contacts are connected via suitable vias, while the interior circular areas, e.g. 434, are pass through holes to facilitate interconnections to the tip and ring conductors 401, 402, 403, 404 of the overlying third layer 390 through vias in the third layer 390.

Figure 28:
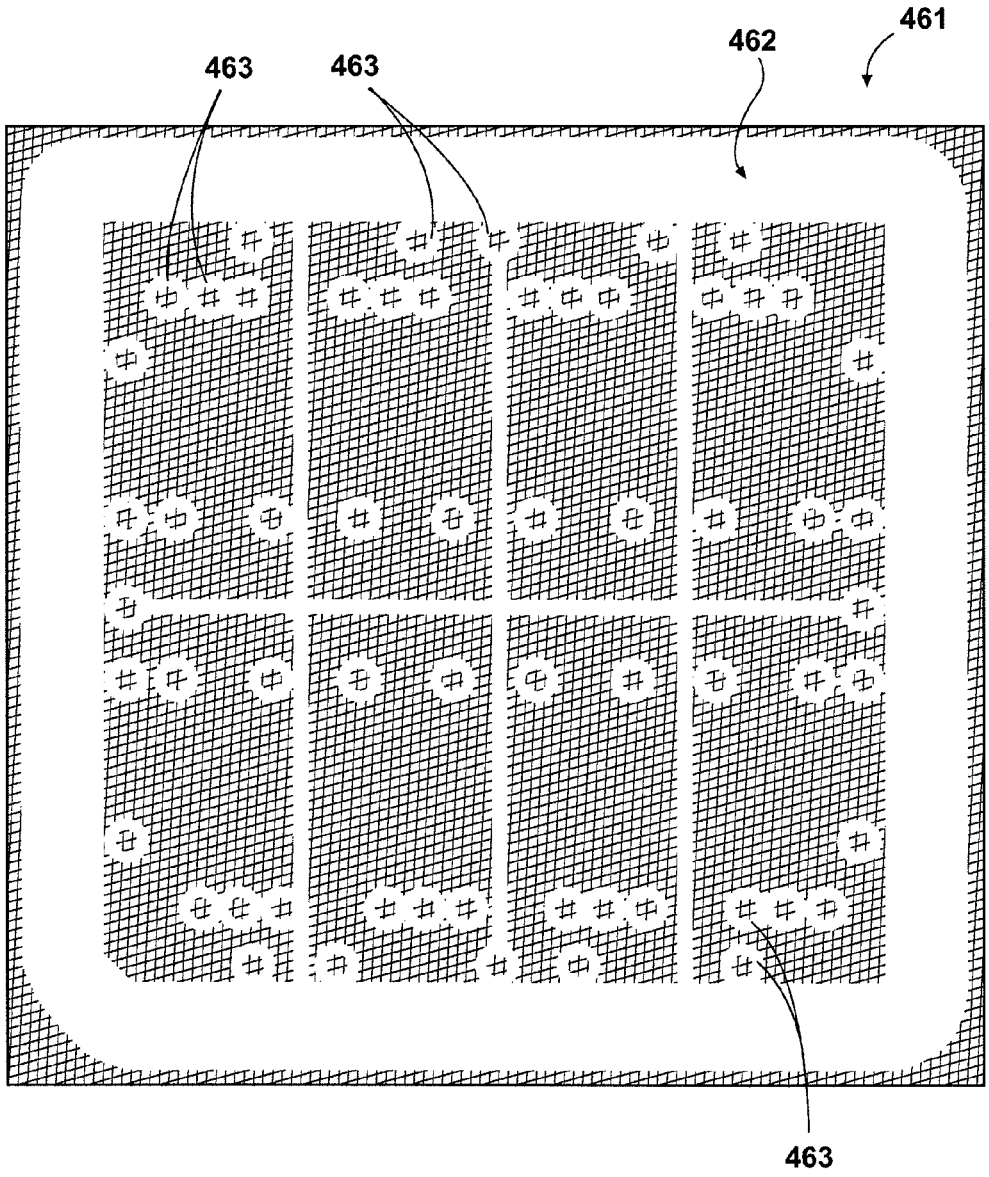
FIG. 28 is a top view of a power plane layer of the alternate base embodiment.

The fifth base layer 461 comprises a power plane whose top surface is illustrated in FIG. 28, and which lies directly below the fourth ground layer 411 and is laminated thereto. The eight generally rectangular crosshatched regions of the layer 461 form eight conductive islands, one supplying power to each $C_{in}$ coil connection. The crosshatched regions within the annular rings, e.g. 463, are conductive vias. The $C_{out}$ coil connections are all connected in common to the crosshatched ground plane of FIG. 27. The conductive areas of layers four and five may comprise etched copper or other conductive material.

Those skilled in the art will appreciate that various adaptations and modifications of the just described illustrated embodiments can be configured without departing from the scope and spirit of the invention. Such embodiments are readily scalable and hence adaptable to numerous configurations and constructions. Therefore, it is to be understood that, within the scope of the appended claims, the invention may be practiced other than as specifically described herein.

What is claimed is:

1. A method comprising:

forming a first layer comprising an insulator substrate having a first plurality of cross conductor segments formed thereon;

forming a second layer comprising an insulating substrate having first and second rows of vias disposed on either side of an electromagnet core material;

forming a third layer comprising an insulator substrate having a second plurality of cross conductor segments formed thereon;

the first and second plurality of conductors segments and first and second rows of vias being so positioned and formed as to enable formation of a conductive coil when said first, second and third layers are joined together; and laminating said first and third layers to said second layer so as to form said conductive coil.

2. A method of making a switching device or relay comprising:

forming an electromagnet core on at least a first laminatable layer; and forming at least one coil capable of conducting electrical current about said core by laminating additional laminatable layers around said at least one first laminatable layer, the additional laminatable layers comprising sections or planar slices of said coil;

wherein said first laminatable layer is disposed in a horizontal plane and wherein said electromagnet core is horizontally disposed in said plane.

3. The method of claim 2 wherein said coil and said core are configured to generate a horizontally directed magnetic field.

4. A method of making a switching device or relay comprising:

forming an electromagnet core on at least a first laminatable layer; and forming an inner coil and outer coil, each capable of conducting electrical current, around said electromagnet core by laminating additional laminatable layers about said at least one first laminatable layer, said additional laminatable layers comprising sections or planar slices of said inner and outer coils, wherein the inner coil lies entirely inside the perimeter of said outer coil.

5. The method of claim 4 wherein said first laminatable layer is disposed in a horizontal plane and wherein said electromagnet core is horizontally disposed in said plane.

6. The method of claim 5 wherein said coil and said core are configured to generate a horizontally directed magnetic field.

7. The method of claim 3 wherein said additional laminatable layers cover and conceal said electromagnet core.

8. The method of claim 6 wherein said additional laminatable layers cover and conceal said electromagnet core.

* * * * *